US006102101A

United States Patent [19]

Hanazaki et al.

[11] Patent Number: 6,102,101

[45] Date of Patent: Aug. 15, 2000

[54] CONTINUOUS CASTING METHOD AND APPARATUS THEREOF

[75] Inventors: Kazuharu Hanazaki, Kashima; Masakazu Koide, Narashino; Toshihiko Murakami, Kashima; Masahiko Oka, Kashima; Seiji Kumakura, Kashima; Kazuo Okamura, Nishinomiya, all of Japan

[73] Assignee: Sumitomo Metal Industries, Ltd., Osaka, Japan

[21] Appl. No.: 08/849,868

[22] PCT Filed: Oct. 15, 1996

[86] PCT No.: PCT/JP96/02983

§ 371 Date: Jun. 18, 1997

§ 102(e) Date: Jun. 18, 1997

[87] PCT Pub. No.: WO97/14522

PCT Pub. Date: Apr. 24, 1997

[30] Foreign Application Priority Data

Oct. 18, 1995 [JP] Japan ..... 7-270346

[51] Int. Cl.[7] ..... B22D 11/128; B22D 11/20

[52] U.S. Cl. ..... 164/452; 164/154.1; 164/154.5; 164/154.8; 164/417; 164/476

[58] Field of Search ..... 164/452, 451, 164/476, 154.1, 154.5, 154.8, 417, 424

[56] References Cited

U.S. PATENT DOCUMENTS 5,488,987 2/1996 DiGiusto et al. ..... 164/476 X 5,577,548 11/1996 Hohenbichler et al. ..... 164/476 X

FOREIGN PATENT DOCUMENTS

| | | |
|---|---|---|
| 55-3071 | 1/1980 | Japan . |
| 62-130759 | 6/1987 | Japan . |
| 1-271047 | 10/1989 | Japan . |
| 4-75754 | 3/1992 | Japan . |
| 4-64784 | 10/1992 | Japan . |
| 6-28789 | 4/1994 | Japan . |
| 6-28790 | 4/1994 | Japan . |
| 6-246412 | 9/1994 | Japan . |
| 7-8420 | 2/1995 | Japan . |

*Primary Examiner*—J. Reed Batten, Jr.
*Attorney, Agent, or Firm*—Burns, Doane, Swecker & Mathis, LLP

[57] ABSTRACT

A continuous casting method and apparatus therefor wherein a reaction force/reduction controller selects a pivot reduction roll such that the thickness of the solidified shell of the cast slab having a liquid core is equal to the target thickness $T_{ref}$, and calculates a difference between a thickness $T_{in}$ of the cast slab having a liquid core at the inlet of the reduction roll zone PRT and the target thickness $T_{ref}$, i.e., $\Delta T$. The resulting value of $\Delta T$, i.e., a target reduction is provided to the reduction controllers 2 of the pivot reduction roll. The reaction force/reduction controller 1 assigns target reductions ⅓ $\Delta T$ and ⅔ $\Delta T$ to the two reduction rolls upstream of the pivot reduction roll. The reaction force/reduction controller 1 calculates a target pressure ($P_i+\alpha$) on the basis of the selected value for $\alpha$, and the resulting target pressure ($P_i+\alpha$) is provided to each of the reduction controllers 2 of the reduction rolls, downstream of the pivot reduction roll.

11 Claims, 14 Drawing Sheets

CONTINUOUS CASTING METHOD AND APPARATUS THEREOF

TECHNICAL FIELD

The present invention relates to a continuous casting method and an apparatus therefor in which a cast slab is continuously withdrawn from a mold, and more particularly one in which a cast slab having a liquid core is subjected to reduction so as to produce a thin cast slab.

BACKGROUND ART

A typical method of producing a thin plate includes rolling and forming in a rolling step. In this type of method, it is necessary before application of hot rolling to reheat a cast slab which has once cooled after casting. This process is disadvantageous from the viewpoint of energy consumption.

Recently, a direct hot rolling method has been under development. According to the direct hot rolling method, a cast slab obtained from a continuous casting machine is directly supplied to a rolling mill. Particularly, many attempts have been made to develop a continuous casting method which can produce cast slabs with rough hot rolling being omitted in the direct hot rolling process.

As a method of producing a thin cast slab, there has been proposed a method comprising continuously withdrawing a cast slab out of the mold, reducing the thickness of the cast slab using a plurality of pairs of reduction rolls while it has a liquid core, and cooling the resulting slab. This method is referred to as the liquid core reduction method.

Japanese Patent Publication No. 6-28790/1994 discloses a method of reducing the thickness of cast slabs having a liquid core with pairs of reduction rolls. According to this method, a series of spacers each having a different thickness are inserted between each pair of rolls to produce a cast slab having a target thickness by means of an arrangement in which the thickness of spacers gradually increases for downstream pairs of rolls and the roll gaps between the pair of rolls gradually decrease for downstream pairs of rolls. Cast slabs are subjected to a reduction force corresponding to roll gaps in each of which spacers are inserted. In addition, Japanese Patent Publication No. 6-28789/1994 discloses a method of carrying out casting by applying to each pair of rolls a reduction force which is increased depending on the time required until an unsolidified cast slab withdrawn from a mold reaches respective reduction rolls so that a given amount of roll reduction may be applied to the cast slab before finishing the roll reduction.

SUMMARY OF THE INVENTION

According to the prior art method disclosed in Japanese Patent Publication No. 6-28790/1994, however, a roll gap, which determines the thickness of cast slabs, is determined by spacers, and many spacers must be stored in order to produce a wide variety of thickness of slabs. Spacers must be changed every time the thickness of cast slab is changed. Thus, this method is not practical. In addition, since the reaction force of the roll reduction is not considered, a problem of variation with respect to thickness of cast slabs is inevitable.

On the other hand, since cast slabs have different densities depending on their steel types, a reaction force is also varied. According to the prior art method disclosed in Japanese Patent Publication No. 6-28789/1994, the reduction force is determined by a time interval until a cast slab withdrawn from a mold reaches a reduction roll. Thus, there is a problem that variation in the thickness of cast slabs, which is caused by a change of the reaction force to each of the reduction rolls, cannot be entirely prevented.

In addition, in either method, reduction of roll gaps is described, but there is no description of the case where the roll gap is increased. The amount of strains introduced in the solidification interface during roll reduction of cast slabs having a liquid core is determined depending on the amount of reduction of the liquid core, but not on the reduction speed of the reduction rolls. Thus, however much the reduction speed is increased, there is no internal cracking occurring during roll reduction of a liquid core until a target reduction of the liquid core is achieved as long as the target reduction is within a range where the cast slab is free from internal cracking. However, in the case of releasing roll reduction of a liquid core, i.e., in the case of increasing a roll gap, internal cracking sometimes occurs when the rate of increase of the roll gap is over a certain amount.

An object of the present invention is to provide a continuous casting method and an apparatus for carrying out the method, according to which cast slabs having a desired thickness can be produced with great precision, and also cast slabs having a uniform internal structure free from segregation of impurities in the central area of the slabs can be produced.

Another object of the present invention is to provide a continuous casting method and an apparatus therefor, in which cast slabs free from internal cracking having a uniform internal structure can be produced with great precision even when the roll gap is increased or decreased.

The present invention is a process for continuously casting slabs, which comprises supplying cast slabs continuously withdrawn from a mold to a plurality of reduction devices arranged in tandem, providing a target roll gap, i.e., a roll reduction or target pressure to each of the reduction device, and performing roll reduction of a liquid core with the target roll gap and target pressure capable of being achieved for each of the reduction devices, characterized by selecting one of the plurality of reduction devices as a pivot reduction device, providing (assigning) a target roll gap to the pivot reduction device and each of the apparatuses upstream thereof, and providing (assigning) a target reduction force to each of the reduction devices downstream of the pivot reduction device. Thus, according to the present invention, when a roll gap is decreased, a target roll gap is set so that the thickness of cast slabs is smaller than the thickness of the mold. On the other hand, when the thickness of cast slabs is changed to be larger than before during continuous casting, i.e., when the roll gap increases, the thickness of cast slabs being subjected to reduction of a liquid core is restored to a target valve which is equal to or smaller than that of a mold.

In another aspect, the present invention is a continuous casting apparatus in which cast slabs continuously withdrawn from a mold are supplied to a plurality of reduction devices arranged in tandem, a target roll gap or target pressure is provided (assigned) to each of the reduction device, and roll reduction of a liquid core with the target roll gap or target pressure being able to be achieved for each of the reduction devices is performed, characterized by comprising a means of selecting any one of the plurality of reduction devices as a pivot reduction device, means for providing (assigning) a target roll gap to the pivot reduction device and each of the apparatuses upstream thereof, and means for providing (assigning) a target reduction force to each of the reduction devices downstream of the pivot reduction device. The apparatus of the present invention further comprises means for providing a roll gap smaller than the thickness of the mold based on the means for providing a target roll gap, when a roll gap is decreased, i.e., cast slabs having a thickness smaller than that of the mold are produced. On the other hand, the apparatus of the present invention further comprises means for providing a roll gap larger than that being used, based on said means for providing a target roll gap, when the roll gap increases, i.e., when the thickness of cast slabs is changed to be larger than before during continuous casting (hereunder sometimes merely referred to as "release of roll gap").

Thus, according to the present invention, a cast slab continuously withdrawn from a mold with a solidified shell surrounding a liquid core is supplied to a plurality of reduction devices arranged in tandem. As the cast slab goes downstream toward the reduction device, the cast slab is cooled, and an unsolidified portion thereof is gradually solidified with an increase in thickness of the solidified shell. A position of a cast slab from the mold where the thickness of the solidified shell reaches a target one is calculated, for example, by using equation (2) to be described later or based on the thermal conductivity in a manner described in FIG. 13 to be explained later. A reduction device which is disposed at a position closest to the calculated position of the cast slab is selected as a pivot reduction device.

When the roll gap is decreased, a predetermined pivot reduction device is provided with a roll gap corresponding to a difference between the thickness of the cast slab at the exit of the mold and a target thickness thereof and each of the reduction devices upstream of the reference one is provided with a target roll gap calculated by multiplying the difference by a certain ratio so that cast slabs can be reduced with respect to their thickness gradually at an appropriate proportion through a first half group of the reduction devices including the pivot reduction device. It is possible, therefore, to set any desired target thickness, i.e., roll gap, and to carry out reduction to obtain such a predetermined target thickness of cast slabs.

In addition, each reduction device downstream of the pivot reduction device is provided with a target pressure calculated on the basis of a reaction force previously determined based on the type of steel and on an iron static pressure of the cast slab at the position of the corresponding reduction device. Reduction through a second half group of reduction devices is carried out so that the target pressure can be maintained in each of the reduction devices. The iron static pressure can be calculated based on the density of the cast slab, a height from the reduction device to a meniscus, etc. The reaction force can be set, as described before, depending on the type of cast slab. It is possible, therefore, to prevent occurrence of a variation of thickness of cast slabs, which is sometimes caused by assignment of an unsuitable reaction force to a cast slab.

Thus, according to the present invention, a target roll gap is assigned to the pivot reduction device and a first group of reduction devices upstream thereof, and a target pressure is assigned to a second group of reduction devices downstream of the pivot reduction device. It is possible to perform roll gap control and roll pressure control simultaneously to produce thin cast slabs having a predetermined thickness free from a variation in thickness which is caused by assignment of an unsuitable reaction force.

On the other hand, when the thickness is to be increased during operation, a reduction device which is used as the reference one before is taken as the pivot reduction device. The pivot reduction device is provided with a target roll gap corresponding to a difference between the thickness of the cast slab after reduction in the preceding operation, i.e., the present roll gap, and a new target thickness thereof, and the reference reduction and each of the reduction devices upstream of the reference one as provided with an increased target roll gap calculated by multiplying the difference by a certain ratio so that cast slabs can be reduced with respect to their thickness gradually at an appropriate proportion through a first group of the reduction devices including the pivot reduction device. It is possible, therefore, to set any desired target thickness, i.e., roll gap, and to carry out reduction to obtain cast slabs having an increased target thickness.

In addition, in the same manner as before, each of the reduction devices downstream of the reference device is provided with a target pressure calculated on the basis of a reaction force previously determined based on the type of steel and the iron static pressure of the cast slab at the position of the corresponding reduction device.

In either case of increasing or decreasing a roll gap, the target pressure is set to be larger than the iron static pressure by a certain degree. Thus, it is possible to reduce the thickness of cast slabs at a target pressure for each of the reduction devices downstream of the pivot reduction device without release of reduction due to the iron static pressure during operation to increase the thickness of cast slabs.

The iron static pressure can be calculated based on the density of the cast slab, the height from the reduction device to a meniscus, etc. The reaction force can be set, as described before, depending on the type of steel. It is possible, therefore, to prevent variation in the thickness of cast slabs, which is sometimes caused by assignment of an unsuitable reaction force to a cast slab.

Thus, according to the present invention, even when the thickness is increased during operation, a target roll gap is assigned to the pivot reduction device and the first group of reduction devices upstream of the pivot reduction device, and a target pressure is assigned to the second group of reduction devices downstream of the pivot reduction device. It is possible to perform roll gap control and roll pressure control simultaneously to produce thin cast slabs having a predetermined thickness free from a variation in thickness which is caused by assignment of an unsuitable reaction force.

In the case of either an increasing or decreasing roll gap, the thickness of a cast slab at the exit of the pivot reduction device is determined on the basis of a value detected by a thickness meter, or on the basis of a roll gap of the reduction device next to the pivot reduction device on the downstream side. When the determined thickness is smaller than the target thickness, it is judged that the thickness of the unsolidified portion of the slab is excessively large, and in place of the present pivot reduction device, the reduction device next to the pivot reduction one on the downstream side is made a new pivot reduction device. In addition, the roll gap is detected for the pivot reduction device. When the detected roll gap is larger than a difference between the thickness of the cast slab withdrawn from the mold and a target thickness, it is judged that the thickness of the unsolidified portion of the slab is excessively large, and in place of the present pivot reduction device, the reduction device next to the pivot reduction one on the upstream side is made a new pivot reduction device. Thus, according to the present invention, a pivot reduction device is always suitably selected.

In case of either an increasing or decreasing roll gap, in the pivot reduction device and the reduction devices upstream of the pivot reduction device, the direction of pressure applied to a hydraulic double-acting cylinder is determined based on whether the values detected by the roll gap detector and a difference from the target roll gap are positive or negative. In addition, a pressure corresponding to the difference may be made a target pressure, and the degree of opening of a pressure control valve can be adjusted on the basis of the target pressure and a value detected by a pressure meter. The pressure control valve is operated such that a predetermined degree of opening is achieved, and the switching valve is operated such that a predetermined direction of pressure is achieved. Thus, the roll gap of each of the reduction devices can be adjusted to respective target roll gaps by operating the switching valve and pressure control valve.

In the reduction devices downstream of the pivot reduction device, the degree of opening of the pressure control valve is determined on the basis of an assigned target pressure and a pressure detected by a pressure gauge, and pressure control is carried out by adjusting the pressure control valve so as to achieve the determined degree of opening.

It is necessary to prevent occurrence of internal cracks of cast slabs when a roll gap must be increased, i.e., when the thickness of cast slabs must be increased. In such situations, the present invention provides a continuous casting method for producing thin cast slabs by applying liquid core reduction in a roll reduction zone, characterized in that the roll reduction force is released in such a way that a rate of increase of the final roll gap is satisfied by the following equation, which determines the target roll gap, when the thickness of cast slabs is returned to a thickness smaller than the original thickness of the cast slab before application of roll reduction.

$$V_R < (V_R)_{Cr} = \epsilon_{Cr}\frac{5L^2V_C}{9DL_S} \times 10^{-4}$$

wherein $V_R$: raising rate of the reduction roll (mm/S)

$V_C$: casting speed (m/min)

L: minimum roll pitch, i.e., minimum distance from one roll to the next roll in the roll reduction zone (mm)

$L_S$: length of roll reduction zone (m)

$\epsilon_{Cr}$: critical strains of internal cracks of cast steel (%)

D: maximum solidified shell thickness at the exit of a liquid reducing roll (mm)

DETAILED DESCRIPTION OF THE INVENTION

Embodiments of the present invention will be explained in further detail with reference to the accompanying drawings.

Figure 1:
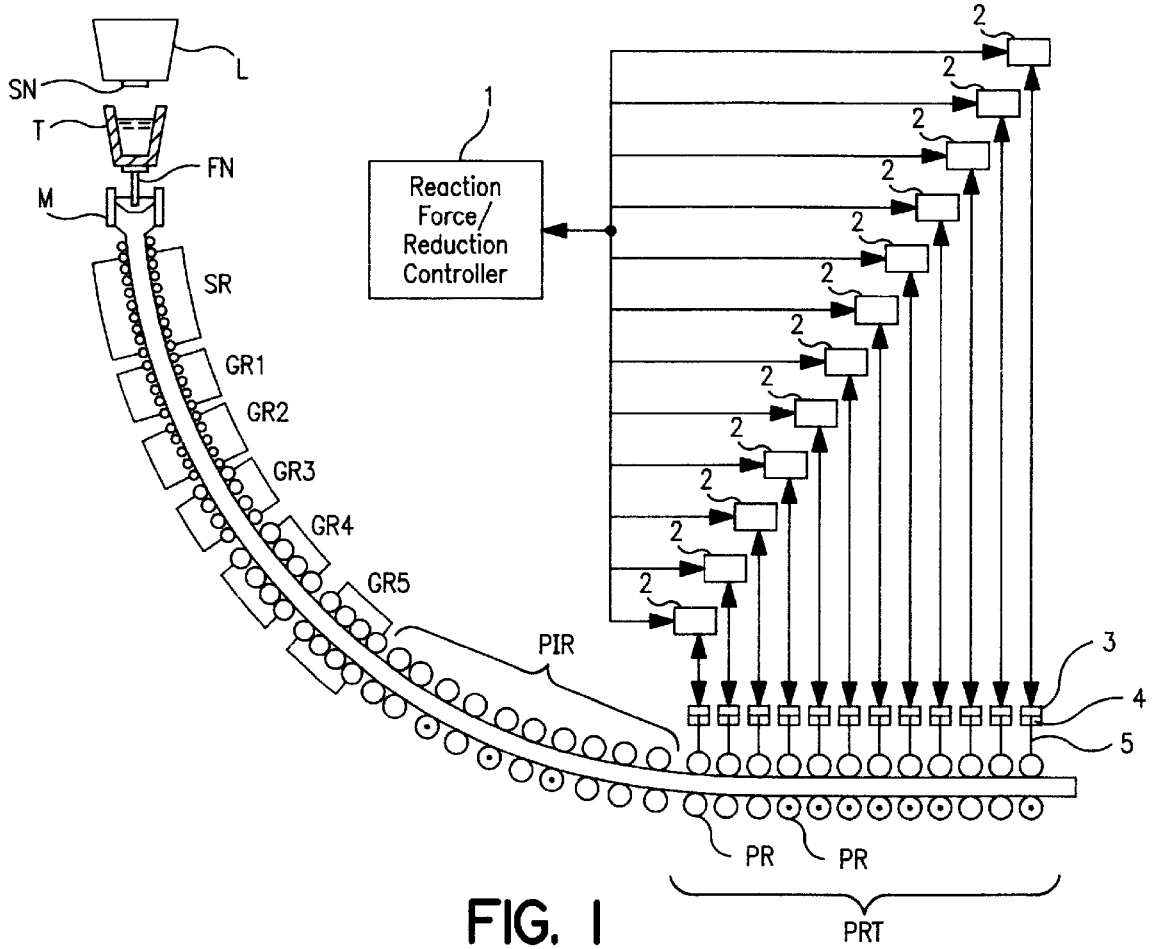
FIG. 1 is a diagrammatic illustration of a bent-type continuous casting machine for producing slabs of the present invention.

FIG. 1 is a diagrammatic illustration of a bent-type continuous casting machine for producing slabs. In the figure, a ladle L in which a molten steel is contained is moved to above a tundish T. At the bottom of the ladle L a sliding nozzle SN is provided. When the sliding nozzle is opened, a molten steel within the ladle L is passed into the tundish T and stored therein temporarily.

At the bottom of the tundish T, a feed nozzle FN is disposed and extends into a mold M having a shape of a rectangular barrel. A molten metal introduced into the tundish T is kept there temporarily, and then the molten steel is poured into the mold M as a stable flow via the feed nozzle FN. The molten steel poured into the mold is cooled and withdrawn from the mold as cast slabs having a solidified shell surrounding a liquid core. Downstream of the mold M is provided a spray roll zone where cooling water is sprayed at the cast slab. In the spray roll zone, an unsolidified portion of the cast slab is further cooled (secondary cooling). Following the spray roll zone SR, a plurality of groups of roll zones $GR_1$, $GR_2$, $GR_3$, $GR_4$, and $GR_5$, and a pinch roll zone PIR are arranged with a prescribed curvature so as to bend the cast slabs having a liquid core while moving them to a horizontal position. Cast slabs having a liquid core are disposed horizontally and then passed to a reduction roll zone PRT where the cast slabs are reduced with respect to their thickness by means of a plurality of reduction rolls PR which are arranged in tandem, and then further cooled while roll reduction is carried out to continuously produce cast slabs.

Each of the reduction rolls PR, PR, . . . is connected to a rod 5 of a piston 4 provided in a hydraulic cylinder 3. A reduction roll PR, hydraulic cylinder 3, and piston rod 4 make up a reduction device. A plurality of reduction controllers 2, each of which controls reduction movement of each of the reduction devices are provided with a target pressure or target roll gap form a reaction force/roll gap controller 1. The positions of pistons 4 and the pressure of cylinders 3 are controlled such that each of the reduction controller 2 is provided with an assigned target pressure or target reduction position.

Figure 2:
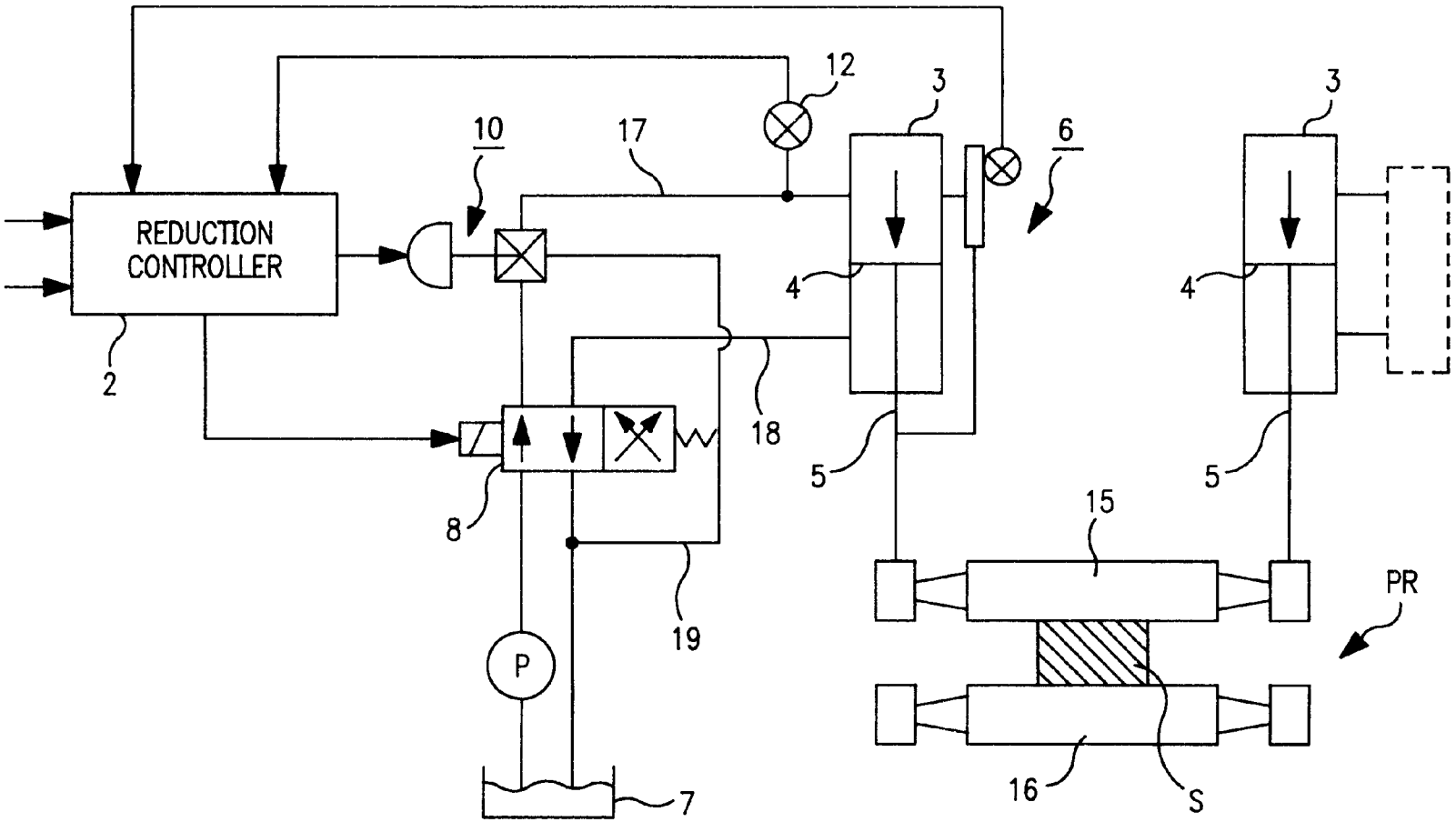
FIG. 2 is a diagrammatic illustration of a control system for a drive mechanism of a reduction device.

FIG. 2 is a diagrammatic illustration of a control system for driving a reduction device. Each of the reduction rolls PR has an upper roll 15 and a lower roll 16. Above the upper roll 15, double-acting hydraulic cylinders 3 are disposed with rods 5 of pistons 4 facing downward. The lower ends of the rods 5 are connected to respective ends of the upper roll 15. The upper roll 15 is provided with a predetermined roll gap or reduction pressure using the hydraulic cylinders 3, so the thickness of a cast slab S having a liquid core is reduced when it passes through the roll gap between the upper and lower rolls 15, 16.

The hydraulic cylinder 3 comprises upper and lower chambers divided by a piston 4, and hydraulic piping 17, 18 connected to the chambers at one end thereof. At its other end, piping 17 is connected via a motor-driven pressure control valve 10 to one port of a magnetic switching valve 8 of the 4 port-2 position type. Piping 18 is connected to another port of the switching valve 8. One of the remaining two ports of the switching valve 8 is connected via a pump P to an oil tank 7, and the other one is directly connected to the oil tank 7. The pressure control valve 10 is provided with piping 19 so as to return excess oil to the oil tank 7 during time period of reducing pressure. When the switching valve 8 is operated to supply oil to one of the tow chambers of the hydraulic cylinder 3, the piston 4 is moved upward or downward. The oil pressure within the hydraulic cylinder 3 is adjusted by the pressure control valve 10. The hydraulic cylinder 3 has a roll gap detector 6. A roll gap detected by the detector 6 is provided to a reduction controller 2. A pressure meter 12 is disposed between the pressure control valve 10 of the piping 17 and the hydraulic cylinder 3 to detect the oil pressure which has been adjusted by the pressure control valve 10. A signal corresponding to the pressure detected by the pressure meter 12 is provided to the reduction controller 2. As described before, the reduction controller 2 is provided with a target pressure and target roll gap from the reaction force/roll gap controller 1 (see FIG. 1), and the reduction controller 2 provides signals to change the opening or the position of the pressure control valve 10 and the switching valve 8, respectively, so that the detected values of the pressure meter 12 and the roll gap detector 6 will be the same as the target pressure and the target roll gap.

Although the above explanation pertains to one of the cylinders 3, the same explanation applies to the other cylinder 3.

The reaction force/reduction controller 1 can determine a target reduction pressure and a target roll gap in the following manner.

Figure 3:
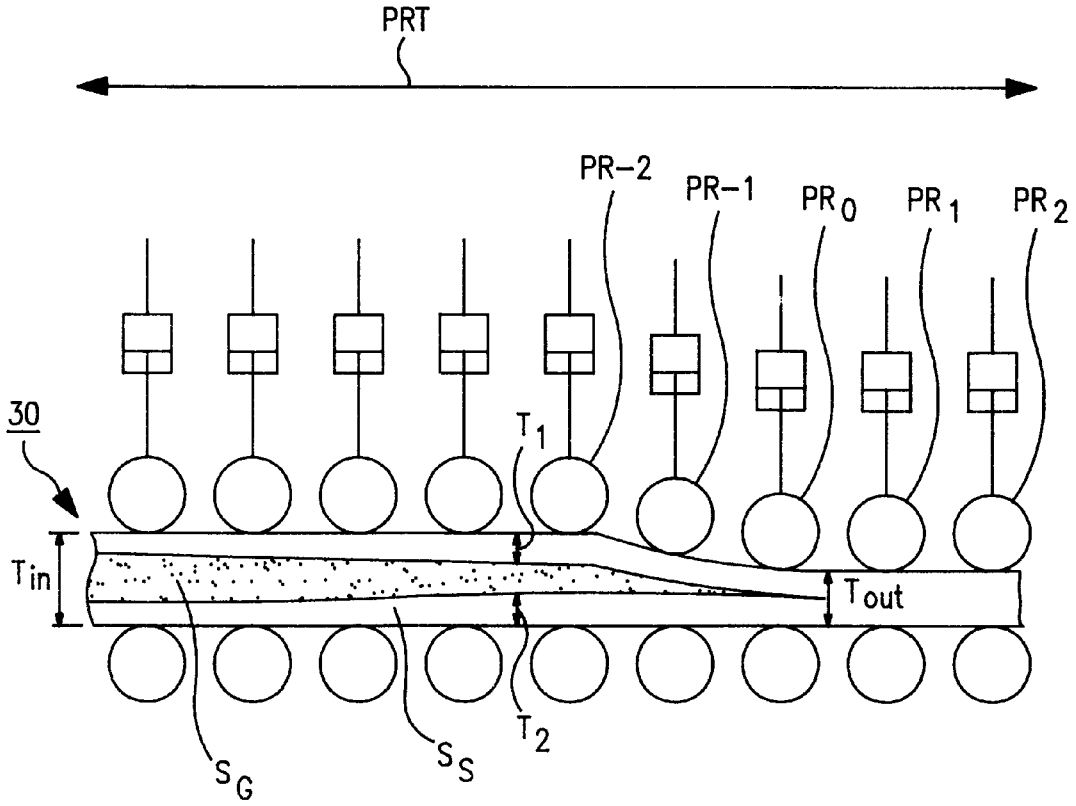
FIG. 3 is a sectional side view of a cast slab having a liquid core which is supplied to a roll reduction zone.

FIG. 3 is a sectional side view of a cast slab 30 having a liquid core which is supplied to a roll reduction zone PRT. The cast slab 30 supplied to the roll reduction zone PRT is cooled by air, and the thickness of a liquid core $S_G$ remaining in the center of the slab decreases gradually, and simultaneously, the thickness of a solidified shell $S_S$ surrounding the liquid core $S_G$ increases. At a final stage, the liquid core $S_G$ of the cast slab disappears.

A pivot reduction roll $PR_0$ is selected from a plurality of reduction rolls PR, PR, . . . in the reduction roll zone PRT of the reaction force/roll gap controller 1 in accordance with the following equations (1) and (2). Namely, the pivot reduction roll $PR_0$ is made the reduction roll which is closest to the position where the sum of the thickness $T_1$ of the solidified shell $S_S$ on the liquid core $S_G$ of the cast slab and the thickness $T_2$ of the solidified shell $S_G$ underneath the liquid core $S_G$, i.e., $T_1+T_2$, is equal to a target thickness $T_{ref}$.

$$T_i=k\sqrt{(L_e/V_C)}=T_{ref} \quad (1)$$

$$L_e=(T_{ref}/k)^2V_C \quad (2)$$

wherein $T_i$: thickness of a solidified shell $$T_i=T_1+T_2$$

k: solidification coefficient obtained based on thermal conductivity (mm $min^{-1/2}$)

$L_e$: distance from the meniscus to the reduction roll (m)

$V_C$: casting speed (m/min)

In another embodiment, the position of the pivot reduction roll can be determined by calculation based on thermal conductivity. See the descriptions relating to FIG. 13.

When a roll gap, i.e., a roll reduction is decreased, after determining the pivot reduction roll $PR_0$, the reaction force/reduction controller 1 provides a reduction controller for the selected pivot reduction roll $PR_0$ with a target reduction, which is equal to the difference ΔT between the thickness $T_{in}$ of the cast slab at the inlet of the roll reduction zone, i.e., the thickness of the mold, and a target thickness $T_{ref}$ ($\Delta T=T_{in}-T_{ref}$).

The reaction force/reduction controller 1 also provides target reductions obtained by multiplying the difference ΔT by predetermined ratios for a certain number of reduction rolls $PR_{-1}$, $PR_{-2}$, . . . upstream of the pivot reduction roll $PR_0$. For example, when two reduction rolls $PR_{-1}$ and $PR_{-2}$ upstream of the pivot reduction roll $PR_0$ are controlled, a target pressure or reduction corresponding to a reduction of ⅓ ΔT is assigned to the reduction controller for reduction roll $PR_{-1}$, and a value of ⅔ ΔT is assigned to reduction roll $PR_{-2}$.

The amounts of ⅓ ΔT, ⅔ ΔT, and Δt are indicated by $S_0$. The reduction controller 2 can be controlled by the following manner based on $S_0$.

Figure 4:
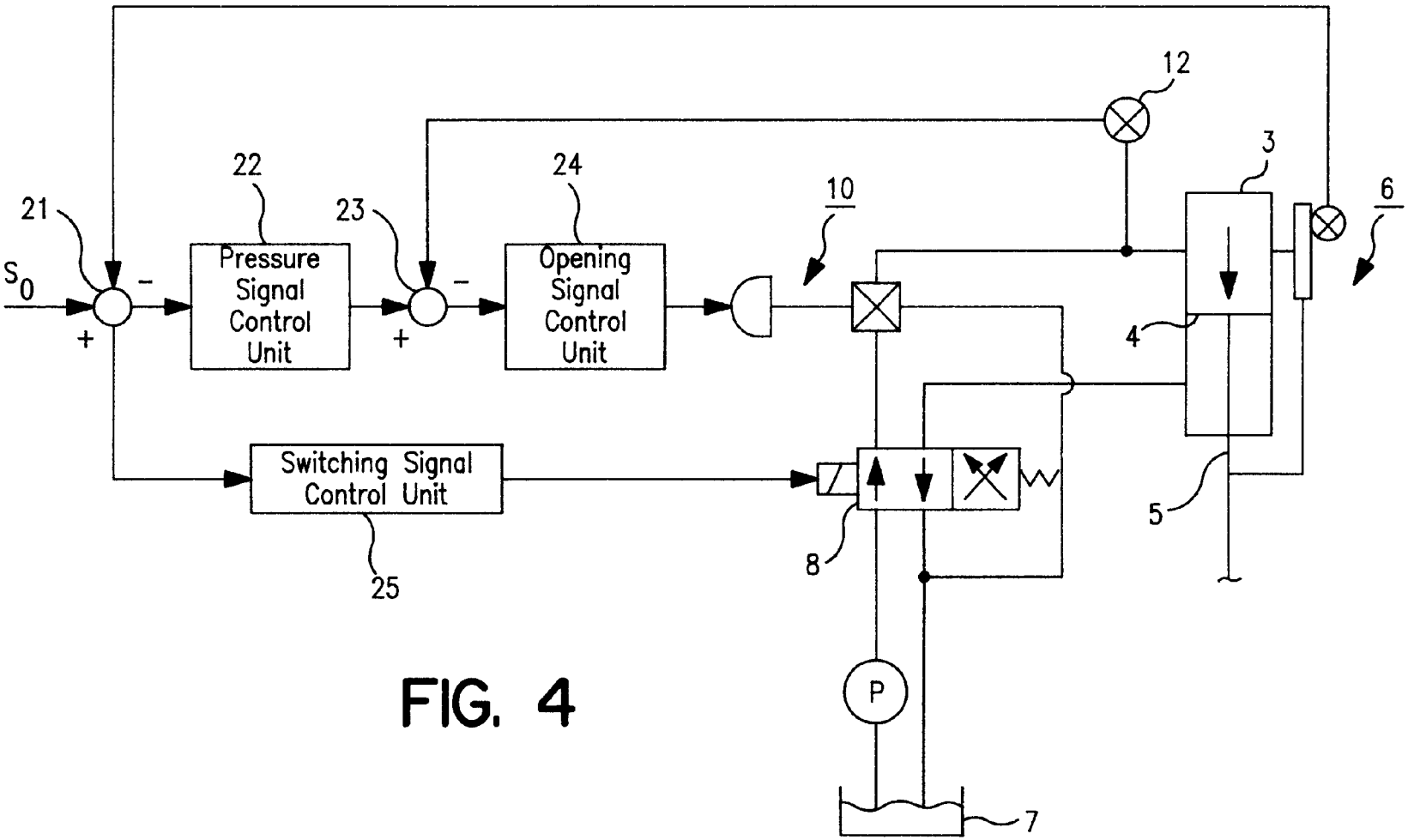
FIG. 4 is a block diagram showing a control logic for a pivot reduction roll and reduction rolls upstream thereof.

FIG. 4 is a block diagram showing control logic for the pivot reduction roll and reduction rolls upstream thereof. The signal $S_0$ is provided to a first subtractor 21 of each of reduction controller 2 which control the pivot reduction roll and the reduction rolls upstream thereof. To the first subtractor 21, reduction data detected by the reduction detector 6 are also provided, and the first subtractor 21 outputs a value obtained by subtracting the detected reduction from $S_0$ to a pressure signal control unit 22. The first subtractor 21 provides the result of subtraction to a switching signal control unit 25. The switching signal control unit 25, depending on whether the resulting data are positive or negative, determines a direction of movement of the piston of the cylinder 3, forms a switching signal, and provides it to the switching valve 8.

The before-mentioned pressure signal control unit 22 calculates by PID calculation a pressure signal corresponding to a difference from a predetermined reduction and provides the signal to a second subtractor 23. To the second subtractor 23, a hydraulic pressure which is adjusted by a pressure control valve 10 is supplied from the pressure meter 12. The second subtractor 23 outputs the difference between the pressure signal and hydraulic pressure to the opening signal control unit 24. The opening signal control unit 24 calculates an opening signal corresponding to the difference by PID calculation and provides the result to the pressure control valve 10 to adjust the degree of opening and to control the reduction.

The reaction force/reduction controller 1 shown in FIG. 1, as shown in FIG. 3, provides a substantial reaction force $\alpha$ and a target pressure $(P_i+\alpha)$ obtained from the following equation (3) to the reduction controllers 2 of the reduction rolls $PR_1$, $PR_2$, . . . downstream of the pivot reduction roll $PR_0$. The substantial reaction force $\alpha$ is varied depending on the type of steel, and the reaction force/reduction controller 1 stores specific values of $\alpha$ for respective types of steel.

$$P_i=(P_0\times S)/A \tag{3}$$

wherein $P_0$: iron static pressure $$P_0=\rho\ g\ h$$

wherein:

$\rho$: density of molten metal g: acceleration of gravity h: height of the molten metal level within tundish from a reduction roll (m)

S: contact surface between roll and cast slab $$S=r_p\times\{W-(T_1+T_2)\}$$

wherein $r_p$: roll pitch

W: width of mold

A: sectional area of the cylinder

Figure 5:
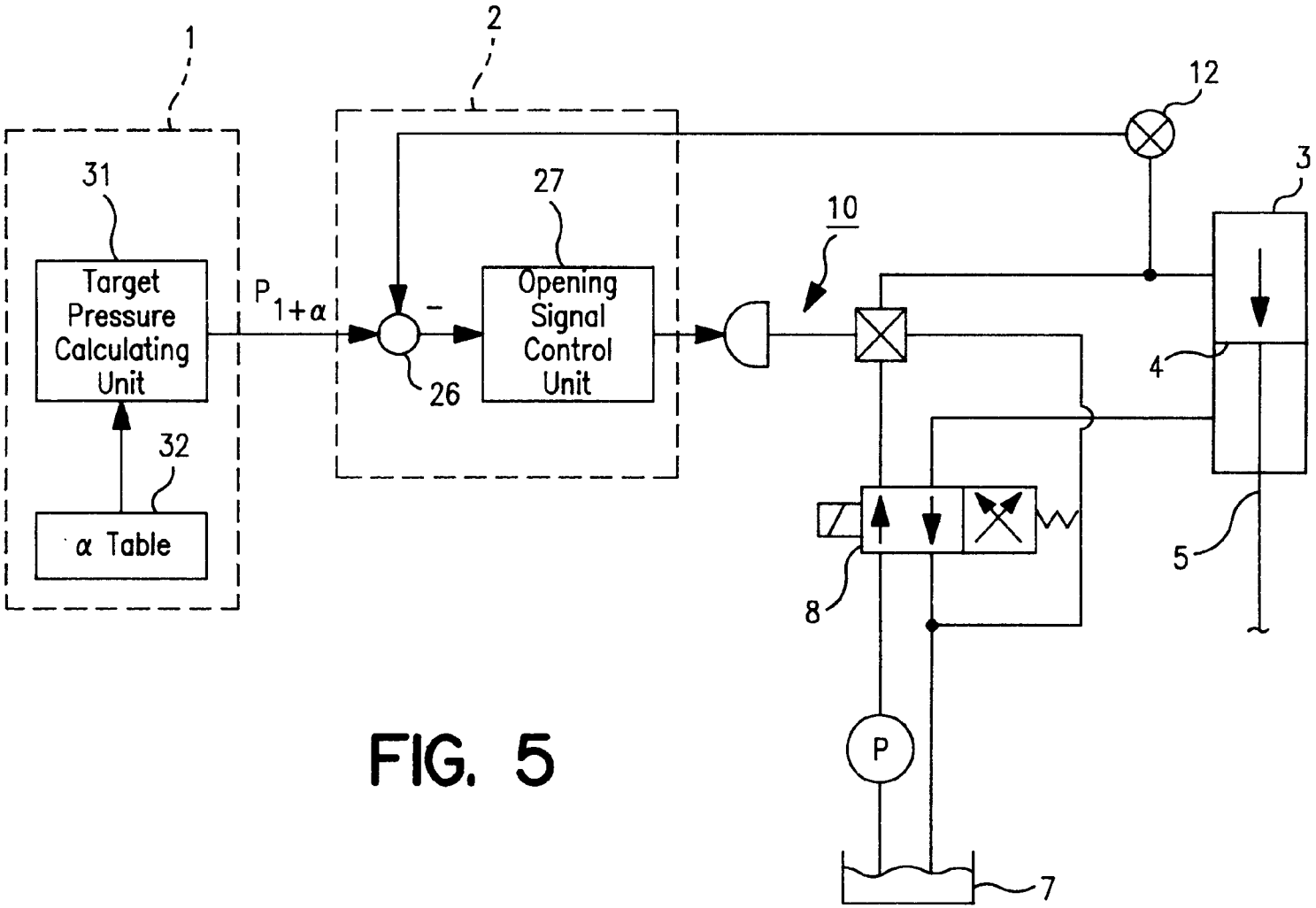
FIG. 5 is a block diagram showing a control logic for reduction rolls downstream of the pivot reduction roll.

FIG. 5 is a block diagram showing a control logic for reduction rolls downstream of the pivot reduction roll $PR_0$. The reaction force/reduction controller 1 has an $\alpha$ table 32 which includes data of $\alpha$ respective for a variety of steels. A target pressure calculating unit 31 reads the data of $\alpha$ for the steel being processed from the $\alpha$ table 32, calculates the target pressure $(P_1+\alpha)$ in accordance with equation (3), and provides the resulting data to a subtractor 26 of the reduction controller 2 which controls the reduction rolls downstream of the pivot reduction roll. To the subtractor 26, the hydraulic pressure which is supplied to the hydraulic cylinder 3 is provided by the pressure meter 12. The hydraulic cylinder 3 is operated at a force f determined in accordance with the following equation (4). The subtractor 26 provides a difference between the target pressure $(P_i+\alpha)$ and a hydraulic pressure detected by the pressure meter 12 to the opening signal control unit 27.

$$f=(P_1+\alpha)\times A \tag{4}$$

The opening signal control unit 27 generates an opening signal corresponding to the determined difference and provides it to a pressure control valve 10 to adjust the degree of opening so that the reduction by the hydraulic cylinder 3 can be controlled. Thus, a reduction corresponding to the reaction force is applied to the cast slab, and cast slabs having a target thickness can be produced with high precision.

Since the pivot reduction roll $PR_0$ is determined by the before-described calculation, which inevitably includes errors, due to the presence of such errors, the thickness of a liquid core is sometimes larger or smaller than $\Delta T$. The reaction force/reduction controller 1 can shift the position of the pivot reduction roll $PR_0$ as follows.

In FIG. 3, on the basis of a reduction detected by the reduction detector 2 (see FIG. 2) which is provided on the reduction roll $PR_1$ next to the pivot reduction roll $PR_0$ on the downstream side, the distance between the upper and lower rolls of this reduction roll $PR_1$ is determined. This distance is the thickness $T_{out}$ at the exit of the pivot reduction roll $PR_0$. When $T_{out}<T_{ref}$, i.e., the thickness of the liquid core is larger than $\Delta T$, the reaction force/reduction controller 1 changes the position of the pivot reduction roll $PR_0$ to the one immediately downstream of the previous pivot reduction roll. The reaction force/reduction controller 1 repeatedly determines $T_{out}$ and shifts the position of the pivot reduction roll until $T_{ref}-T_{out}=0$.

When the thickness of a liquid core is larger than $\Delta T$, since the actual reduction at the pivot reduction roll $PR_0$ is $\Delta T-\alpha$ and a large reaction force is produced, the reaction force/reduction controller 1, based on the reduction detected by the reduction detecting device 6 disposed on the pivot reduction roll $PR_0$, shifts the position of the pivot reduction roll $PR_0$ to the roll just upstream of the previous pivot reduction roll fi the actual reduction is equal to $\Delta T-\alpha$. The reaction force/reduction controller 1 repeatedly shifts the position of the pivot reduction roll $PR_0$ until the actual reduction is equal to $\Delta T$.

When the position of the pivot reduction roll $PR_0$ is changed, the reaction force/reduction controller 1 provides a target reduction and a target pressure which can result in the same reduction as that previously determined to the reduction rolls $PR_{-1}$, $PR_{-2}$, . . . upstream of the pivot reduction roll $PR_0$ after correction, and to the reduction rolls $PR_1$, $PR_2$, . . . , downstream of the pivot reduction roll $PR_0$.

In order to select the pivot reduction roll, either of the following methods may be used. One method is to select it in accordance with a roll reduction detected by a series of steps S1 through S12 shown in FIG. 6*a* through FIG. 6*c*, and the other is to select it on the basis of reaction forces.

Figure 6A:
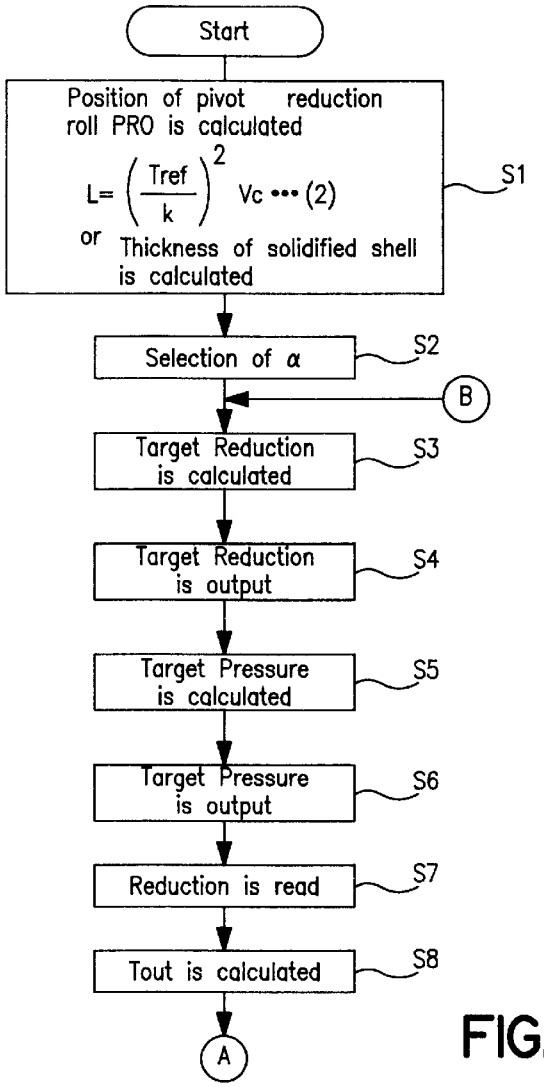
FIGS. 6*a,* 6*b,* and 6*c* are flow charts describing processes for calculating a target roll gap and a target pressure, and for determining a pivot reduction roll, respectively.
Figure 6B:
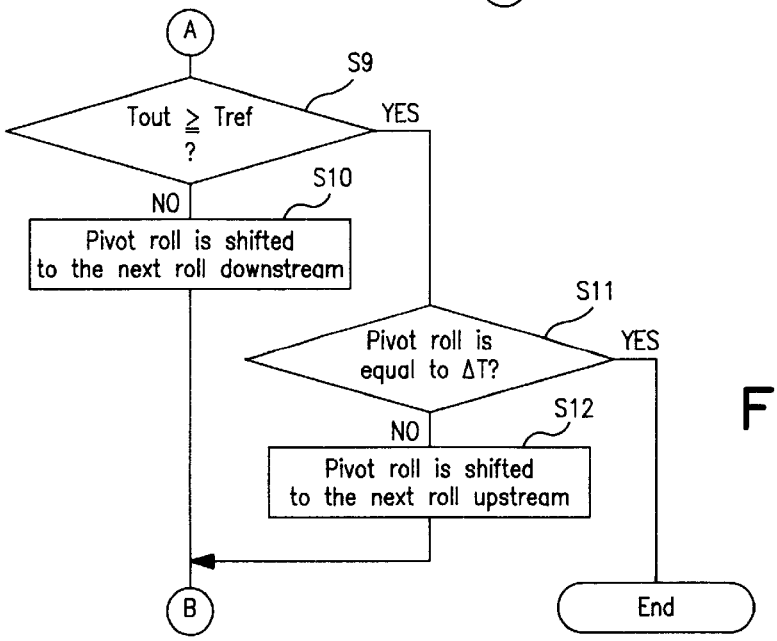
Figure 6C:
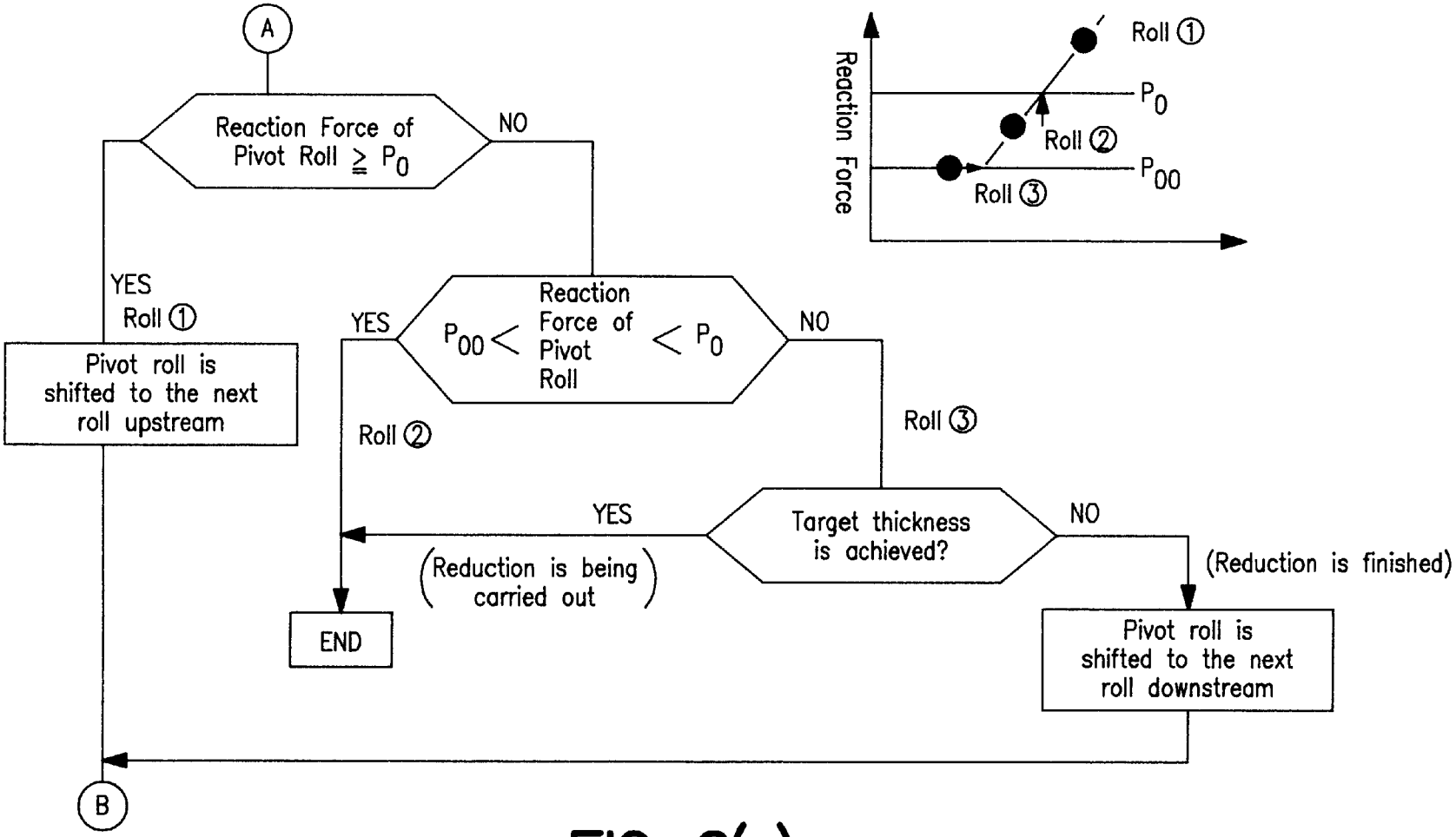

FIGS. 6*a* through 6*c* are flow charts describing processes for calculating a target roll reduction and a target pressure and for selecting the pivot reduction roll in the reaction force/reduction controller 1.

The reaction force/reduction controller 1 is provided with a target thickness $T_{ref}$ of cast slabs. A pivot reduction roll $PR_0$ is selected from the reduction rolls of the reduction roll zone PRT in accordance with the before-described equations (1) and (2) such that the thickness $(T_1+T_2)$ of the solidified shell $S_S$ of the cast slab having a liquid core is equal to the target thickness $T_{ref}$ (Step $S_1$).

The reaction force/reduction controller 1 is also provided with data of substantial reaction force $\alpha$ for each type of steel, and the reaction force/reaction controller 1 chooses a specific value of $\alpha$ for the steel being processed (Step $S_2$). After the pivot reduction roll $PR_0$ is selected, the reaction force/reduction controller 1 calculates a difference between a thickness $T_{in}$ of the cast slab having a liquid core at the inlet of the reduction roll zone PRT and the target thickness $T_{ref}$, i.e., $\Delta T=T_{in}-T_{ref}$ (Step $S_3$). The resulting value of $\Delta T$, i.e., a target reduction is provided to the reduction controllers 2 of the pivot reduction roll $PR_0$ (Step $S_4$). The reaction force/reduction controller 1 assigns target reductions calculated by multiplying the difference $\Delta T$ by ⅓ and ⅔, respectively, i.e, ⅓ $\Delta T$ and ⅔ $\Delta T$ to the two reduction rolls upstream of the pivot reduction roll $PR_0$ (Steps $S_3$, $S_4$).

The reaction force/reduction controller 1 calculates a target pressure $(P_i+\alpha)$ on the basis of the selected value for $\alpha$ and the before-described equation (3) (Step $S_5$), and the resulting target pressure ($P_i+\alpha$) is provided to each of the reduction controllers 2 of the reduction rolls $PR_1$, $PR_2$, . . . downstream of the pivot reduction roll $PR_0$. (Step $S_6$).

The reaction force/reduction controller 1 reads detected data of the reduction detectors 6 fixed to the reduction roll $PR_1$ downstream of the pivot reduction roll $PR_0$ (Step $S_7$). the distance between the upper and lower rolls of the reduction roll $PR_1$, which is detected by the reduction detector 6, is taken as the thickness $T_{out}$ at this exit of the pivot reduction roll $PR_0$ (Step $S_8$). The reaction force/reduction controller 1 decides whether $T_{out} \geqq T_{ref}$ (Step $S_9$). When the inequality $T_{out} \geqq T_{ref}$ is not satisfied, the reaction force/reduction controller 1 decides to shift the position of the pivot reduction roll $PR_0$ to the next roll downstream (Step $S_{10}$)and returns to Step $S_3$. See FIG. 6*a.* This process is repeated until the inequality $T_{out} \geqq T_{ref}$ is satisfied in Step $S_9$.

When it is determined that the inequality $T_{out} \geqq T_{ref}$ is satisfied in Step $S_9$, the reaction force/reduction controller 1 decides whether the actual reduction is equal to $\Delta T$ on the basis of the detected data of the reduction detector 6 fixed to the pivot reduction roll $PR_0$ (Step $S_{11}$). If it is not equal to $\Delta T$, the pivot reduction roll $PR_0$ is made the next roll upstream at the time when the detected data reach $\Delta T-\alpha$ (Step $S_{12}$), and Step $S_3$ is returned to. This process is repeated in the reaction force/reduction controller 1 until it is decided that the actual reduction is equal to $\Delta T$ in Step $S_{11}$.

Alternatively, as shown in FIG. 6*c,* if it is judged that the reaction force of the pivot reduction roll is larger than the presetting pressure ($P_o$~$P_{oo}$), i.e., $P_o$<, the present position of the pivot reduction roll is unsuitable, so the position is shifted to the next roll upstream. When the reaction pressure is within the range of $P_o$~$P_{oo}$, it is decided that the position of the pivot reduction roll is suitable. In contrast, if the roll reduction is finished at a pressure smaller than the preset value, it is decided that the position of the pivot reduction roll is not suitable, and the position is shifted to the next roll downstream.

The explanation above has been made with reference to the case in which the thickness of the cast slab is reduced. When it is necessary to increase the thickness of the cast slab, e.g., when the thickness once reduced is to be increased, or when the thickness once reduced is to be restored to its starting one, the target thickness $T_{out-1}$ before change must be increased to a new target thickness $T_{out-2}$, where $T_{out-2} \leqq T_{in}$.

In this case, the pivot reduction roll $PR_0$ before change is decided to be used as a new pivot reduction roll, and a reduction controller for the reaction force may provide an increase of reduction by a difference between the solidified shell thickness $T_{out-1}$ of the present cast slab and an increased target thickness $T_{out-2}$, i.e., $\Delta T_2=T_{out=2}-T_{out-1}$ to the reduction controller of the pivot reduction roll $PR_0$.

In addition, the reaction force/reduction controller calculates new target reductions each having an increase obtained by multiplying the before-described difference $\Delta T_2$ by a given ratio, and provides them to each of a predetermined number of reduction rolls $PR_{-1}$, $PR_{-2}$, . . . upstream of the pivot reduction roll $PR_0$. When two reduction rolls $PR_{-1}$ and $PR_{-2}$ upstream of the pivot reduction roll $PR_0$ are to be controlled, for example, the reduction controller of reduction roll $PR_{-1}$ is provided with a target pressure and reduction having an increase of $\frac{1}{3}\Delta T_2$, and the reduction controller of reduction roll $PR_{-2}$ is provided with a target pressure and reduction having an increase of $\frac{2}{3}\Delta T_2$.

Thus, if $\frac{1}{3}\Delta T_2$, $\frac{2}{3}\Delta T_2$, or $\Delta T_2$ is taken as $S_0$, the reduction controller 2 can be controlled using the value of $S_0$ in accordance with the control logic which is applicable to the pivot reduction roll and reduction rolls upstream thereof, as shown in FIG. 4, for example. Furthermore, control of reaction force during reduction for the reduction rolls $PR_i$ downstream of the pivot reduction roll $PR_0$ and correction of the position of the pivot reduction roll can be done in the same manner as in the case of reduction of thickness.

In the embodiments described before, the reduction device is of the oil-actuated type, but in accordance with the present invention, in place of oil, other mediums may be used.

In addition, the reduction device is actuated by a cylinder, but a screw jack, for example, may be used.

Figure 7:
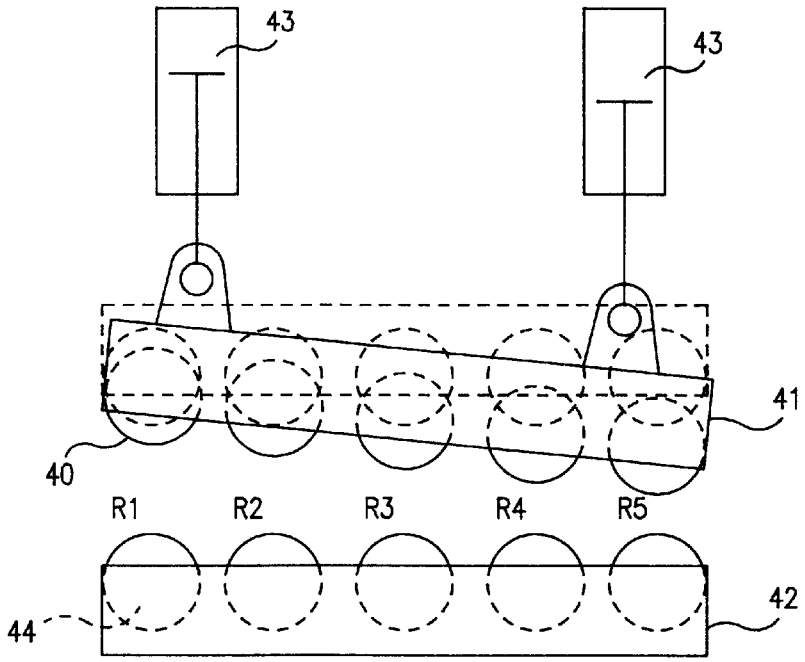
FIG. 7 is a diagrammatic illustration of a reduction device for cast slabs having a liquid core, which is employed by the present invention.

There are a variety of means of carrying out reduction of cast slabs having a liquid core. Thus far the present invention has been described with reference to a case in which invention has been described with reference to a case in which each of the reduction rolls is independently controlled with respect to its reaction force or reduction. As shown in FIG. 7, as a cheaper and easily operated device to control reduction more precisely, there is proposed a device comprising segmented frames each having cast slab supporting rolls 40 in the roll reduction zone PRT, one of the frames being a movable frame 41 which is movable in the direction of the cast slab, and the other frame being a fixed frame 42. The movable frame 41 can be made to slope by hydraulic devices 43 to effect reduction. In the illustrated case, two hydraulic pressure means are used to control the reduction performed by rolls $R_1$ to $R_5$.

When liquid core reduction is carried out, the inner quality of the resulting cast slab is not adversely affected. However, when release of the reduction is carried out, the inner quality of the resulting cast slab is sometimes degraded.

Namely, the amount of strains introduced at the solidification interface during reduction of a cast slab having a liquid core is determined only by the amount of reduction, not by the reduction rate. As long as the amount of reduction is so small that no internal cracks occur, even if the reduction rate is increased to any degree, there will be no internal cracks during reduction to a target thickness. On the other hand, in the case of increasing a roll gap, if a releasing speed of the reduction is increased beyond a certain point, strains are newly introduced, causing internal cracks in accordance with the following mechanism.

The arrangement shown in FIG. 7 in which segmented reduction rolls are employed will be used as an example. According to the embodiment shown in FIG. 8, when the reduction is released, reduction rolls fixed to the movable frame 41 are moved away from the cast slab SB. When the cast slab contacting a roll j at a time t(i) moves to a roll j+1at a time t(i+1), a clearance 45 will be formed between the cast slab and the roll at the position of roll j+1 if a roll gap G (j+1, i+1),i.e., the shortest distance between the roll surfaces of the rolls on movable frame 41 and the fixed frame 42 for the roll j+1 at time t(i+1) is larger than the thickness of the cast slab at time t(i), i.e., the roll gap G (j, i) of roll j at time t(i).

The clearance 45 first occurs at the exit roll of the segmented rolls, and it spreads to upstream rolls.

Figure 9:
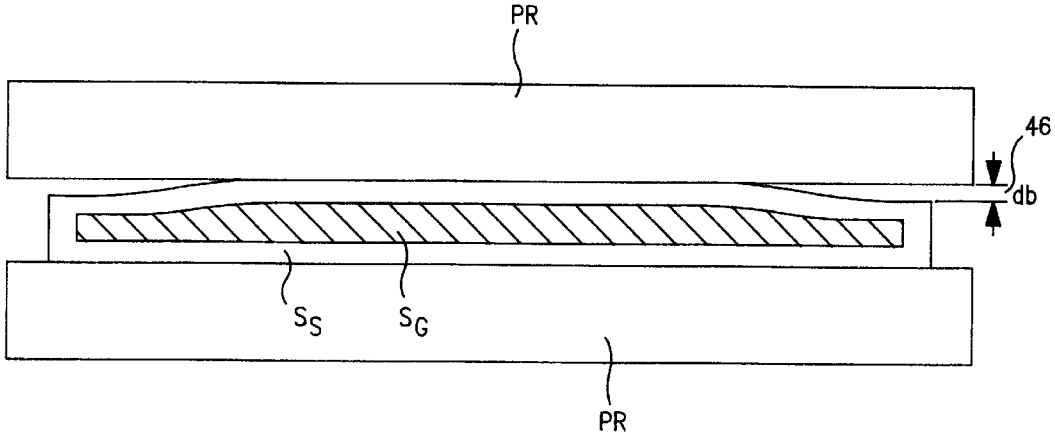
FIG. 9 is an illustration showing the occurrence of bulging deformation caused by clearance between the cast slab and supporting rolls during releasing roll reduction.

FIG. 9 illustrates the shape of a cast slab during release of reduction, in which a solidified shell $S_S$ receives a static pressure from a unsolidified portion $S_G$, and at the position of the slab supporting roll PR, a deformation 46 due to bulging occurs to occupy the clearance. The deformation caused by bulging is hereunder called "bulging deformation" in order to distinguish it from general bulging occurring between rolls. The amount of bulging deformation can be defined by the difference (db) between the roll gap and a thickness of the cast slab at the edge portions thereof.

Figure 10:
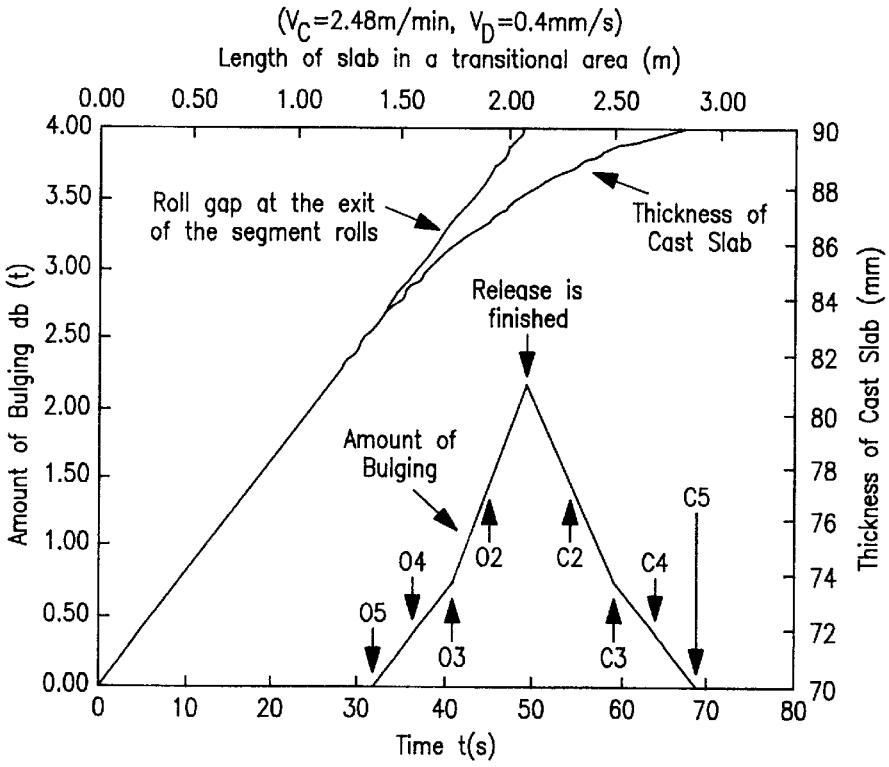
FIG. 10 is a graph showing the amount of bulging as a function of time during releasing roll reduction.

FIG. 10 shows the bulging deformation at the exit of the segmented reduction rolls when release of reduction of a cast slab having a liquid core is carried out using segmented rolls comprised of 5 supporting rolls, as in FIG. 7. The bulging deformation occurs during the second half of release of reduction. The maximum is reached at the end of release of reduction. The time when the release of reduction is finished is the point when an unsolidified portion disappears and the roll gap at the exit of the segmented rolls reaches a target thickness. In the case illustrated in FIG. 10, it was 50 seconds after the release was started. After the completion of release, the bulging deformation remains until the thickness of the edge portions of the slab reaches a target value, e.g., 90 mm in the case of FIG. 10. The distance the cast slab passes in a time period from the beginning of the bulging deformation to the attainment of the maximum level thereof is equal to the length $L_S$ of the segmented rolls for carrying out liquid core reduction. The distance the cast slab passes in a time period from the maximum bulging deformation t the elimination of the bulging deformation is also equal to the length $L_S$.

It is noted from FIG. 10 that the bulging deformation occurs at an exit roll of the segmented rolls (the 5th roll $R_5$ of FIG. 7 in the case of FIG. 10) at the time when a clearance is formed between a roll and the cast slab. Until the bulging deformation reaches a maximum value, the clearance is formed at roll 4 ($R_4$), roll 3 ($R_3$), and roll 2 ($R_2$) successively, corresponding to points 04, 03, and 02 in FIG. 10, for example, and the bulging deformation increases. After reaching a maximum level, the clearance disappears gradually while the cast slab passes from roll 2 ($R_2$) through roll 5 ($R_5$) successively when the roll gap is equal to the thickness of the slab at its edge portions. See points C2, C3, C4, and C5 of FIG. 10.

Figure 11:
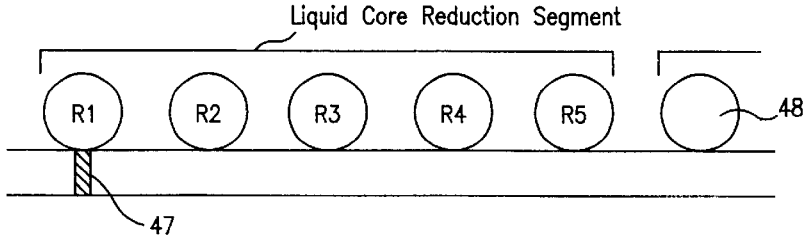
FIGS. 11*a* through 11*f* are diagrammatic views showing releasing strains introduced into a cast slab having a liquid core by roll reduction while a portion of maximum bulging of the cast slab is passing from one segment of the roll reduction zone to the next segment.
Figure 11:
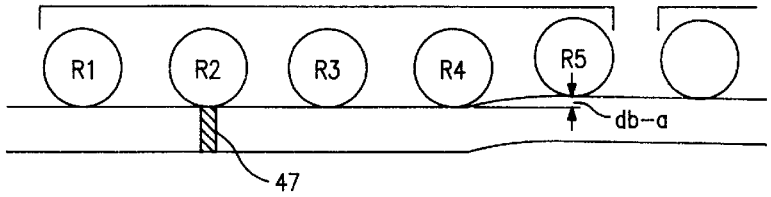
Figure 11:
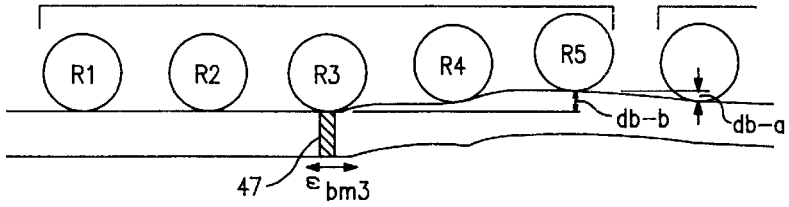
Figure 11:
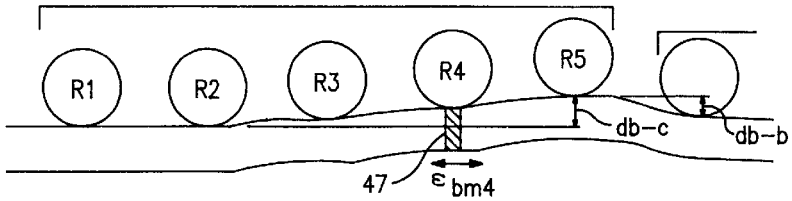
Figure 11:
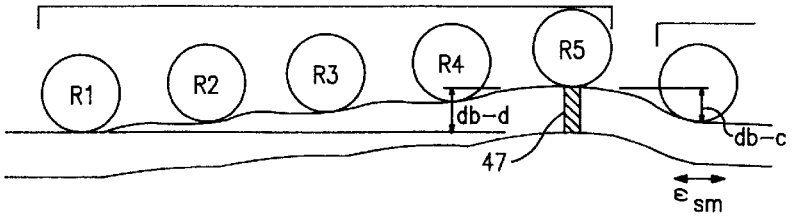
Figure 11:
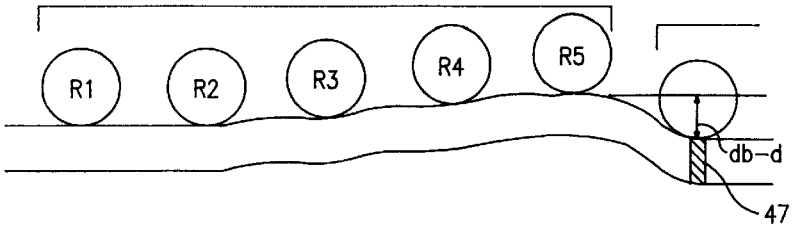

FIG. 11 shows the change in the shape of a cast slab when a portion of the slab where the maximum bulging deformation occurs at the exit of the segmented rolls is passing through the segmented rolls. In FIG. 11, the area of interest is cross-hatched. It is to be noted that FIG. 11 does not illustrate an exact pass line of the segmented rolls, but illustrates a relative position between a solidified shell at the widthwise central portion of the slab and supporting rolls so as to clearly explain occurrence of bulging rand roll reduction of the portion where the bulging occurs.

Since the distance over which the cast slab passes during the time period from the generation of bulging deformation to attainment of the maximum level thereof is equal to the length of a segmented roll group, contact of the cast slab with rolls is as shown in FIG. 11*a* when the noted portion 47 of the cast slab is located at the inlet of the segmented group of rolls. This situation corresponds to that indicated by point 05 of FIG. 10 where a clearance is first generated between the 5th roll ($R_5$) and the cast slab. When the noted portion 47 is located at the 2nd roll ($R_2$), as shown in FIG. 11*b*, bulging due to formation of the clearance occurs at the 5th roll ($R_5$). This situation corresponds to that indicated by point 04 of FIG. 10, and it is at this point when a clearance is first generated at the 4th roll ($R_4$). Similarly, FIGS. 11*b* through 11*e* show respective states when the noted portion 47 passes the 3rd roll ($R_3$), the 4th roll ($R_4$), and the 5th roll ($R_5$), which correspond to points 03 and 04 and the release finishing point of FIG. 10, respectively.

As is apparent from FIGS. 11(*a*)–11(*f*), since a clearance is not generated at the 1st to the 3rd rolls until the noted portion 47 reaches the 3rd roll ($R_3$), bulging due to formation of the clearance does not occur. When the noted portion 47 reaches the 3rd roll ($R_3$), since bulging due to formation of a clearance occurs at the 4th roll ($R_4$), tensile strains $\epsilon bm3$ (stretching inside the shell due to the bending force applied) in the casting direction are introduced at the solidification interface just below the 3rd roll ($R_3$). The quantity $\epsilon bm$ is called "misalignment strains of the bulging type". When the noted portion 47 reaches the 4th roll ($R_4$), since further bulging deformation occurs at the 5th roll ($R_5$), misalignment strains $\epsilon bm4$ of the bulging type are added.

In the process of the present invention, it is necessary to pinch the cast slab with the upper and lower segment frames at a pressure corresponding to a static iron pressure so as to keep a once-achieved target thickness of the cast slab at segments downstream of the segmented rolls group where reduction of the cast slab having a liquid core is carried out so as to achieve a target thickness. Thus, when a cast slab having bulging deformation such as shown in FIG. 9 reaches normal segments following the liquid core reduction segment, the bulging deformation is again made to disappear by the pressure applied from the segmented rolls group, and a rectangular sectional shape is restored to the cast slab. Reduction in this area, as shown in FIG. 11*e,* adds strains $\epsilon sm$ in the casting direction at the solidification interface in the noted portion 47 of the cast slab. These strains are called "reduction strains of the leveled segment type" or merely "reduction strains of the leveled type". The reduction strains of the leveled type are introduced at the inlet roll 48 of the segment next to the liquid core reduction segment.

When the sum of misalignment strains of the bulging type and reduction strains of the leveled type is larger than a critical amount, internal cracks are formed. Since the amount of these strains is proportional to the amount of bulging, the amount of strains becomes a maximum at the portion where bulging is a maximum. In this respect, the maximum amount of bulging is proportional to the releasing rate of reduction, i.e., the raising rate of the roll, and is inversely proportional to the casting speed. In order to prevent formation of internal cracks, therefore, it is advisable to control the maximum bulging, i.e., control a releasing rate in such a way that the sum of these strains is smaller than a critical amount at which internal cracks start occurring.

Figure 12:
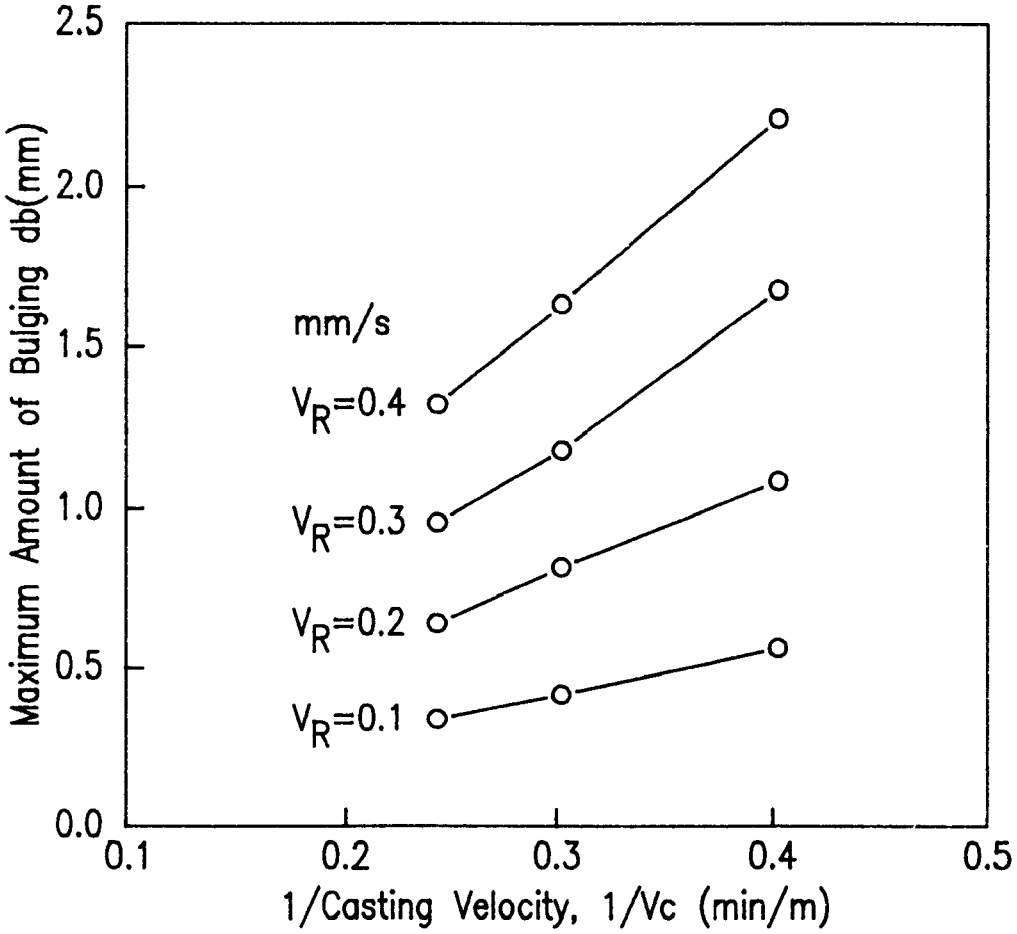
FIG. 12 is a graph showing the maximum amount of bulging db as a function of casting speed Vc for different reduction releasing speeds $V_R$.

In order to describe the releasing rate quantitatively, the releasing rate will be defined as a speed of raising an exit roll of the segmented groups of rolls for carrying out liquid core reduction, i.e., a liquid core reduction segment. A maximum bulging deformation db (mm) at the portion just below the exit roll of the liquid core reduction segment was determined at varied casting speeds Vc (m/min) and releasing rates $V_R$ (mm/S). The results of the determination are shown in FIG. 12. Based on the results, the following relationship can be derived.

$$db=18\times V_R\times L_S/L_C \tag{5}$$

wherein $L_S$ stands for a distance between an inlet roll and an exit roll of the liquid core reduction segment, i.e., the length of the liquid core reduction segment.

As is apparent from equation (5), the maximum bulging db at the exit of the liquid core reduction segment is not affected by the amount of release of reduction, but is varied depending on the releasing rate, the casting speed, and the segment length. The amount of bulging becomes a maximum at a midpoint of the reduction releasing operation, as shown in FIG. 10. The portion of the cast slab where the maximum db is formed is subjected, as illustrated in FIGS.

11(*a*)–11(*f*), to introduction of the misalignment strains of the bulging type at an area between the 3rd roll and the 4th roll and then to reduction strains of the leveled type at the next roll.

According to a finite element analysis made by the inventors, the misalignment strains of the bulging type can be described by the following equation:

$$\epsilon bm=2.74\times(D\ \delta/L^2)\times 100(\%) \tag{6}$$

The reduction strains of the leveled type can be described as follows:

$$\epsilon sm=2.66\times(D\ \delta/L^2)\times 100(\%) \tag{7}$$

wherein:

D: thickness of solidified shell (mm)

δ: amount of bulging

L: roll pitch

In the case shown in FIGS. 11*a*–11*f*, the noted portion 47 is subjected to introduction of the misalignment strains of the bulging type in an area between the 3rd roll ($R_3$) and the 4th roll ($R_4$). This is because the liquid core reduction segment contains five rolls. When the segment contains a different number of rolls, the location of the roll where the noted portion 47 suffers from misalignment strains of the bulging type is also changed. However, such a location is not important, since internal cracks are formed when the amount of strains introduced to a brittle area (usually an area of a solid phase ratio of 0.8–0.99) at the solidification interface of the solidified shell is increased beyond a critical amount. If the strains are repeatedly introduced, the internal cracks are formed at a time when a total amount of the introduced strains is over the critical amount. The maximum amount of bulging is the sum of the amounts of bulging deformation which the noted portion receives at each of the rolls. In addition, the amount of misalignment strains of the bulging type is proportional to the amount of bulging. At each of the rolls where bulging occurs, the amount of the misalignment strains of the bulging type is calculated and summed. The resulting total amount is equal to the amount of strains which are introduced by applying the maximum bulging at one time. The strains caused by releasing the liquid core reduction ($\epsilon_R$: strains by reduction releasing) are a total of the strains obtained by calculation using δ of the equations (6) and (7) and the maximum bulging db, and can be described by the following equation.

$$\epsilon_R = 500\frac{D\delta}{L^2} = 9000\frac{D\cdot V_R\cdot L_S}{L^2\cdot V_C} \tag{8}$$

In order to prevent occurrence of internal cracks, therefore, it is advisable to suppress the formation of strains caused by reduction releasing and also strains caused for other reasons, such as bulging between rolls, thermal stresses, and roll reduction due to roll bending caused by thermal expansion of rolls, so as to restrict the total amount of these strains to be smaller than the critical amount. The later type of strains which are caused by reasons other than releasing of the liquid core reduction are inevitably introduced to cast slabs during usual continuous casting. These strains, therefor, are called "existing strains" for convenience. The amount of existing strains is changed depending on the type of casting machines and operating conditions. However, in order to suppress occurrence of internal cracks caused by releasing of liquid core reduction, or in order to avoid formation of internal cracks caused by accidental malfunction of the casting machine during normal casting without effecting liquid core reduction, casting machines are designed such that the amount of the existing strains is at most 50% or less of the critical amount for internal cracks with a factor of safety being 1.4 or more, although the critical amount varies depending on the type of steel. Thus, if the amount of strains caused by releasing the liquid core reduction ($\epsilon_R$) is restricted to 50% or less of the critical amount for internal cracks, the occurrence of internal cracks can successfully be avoided during releasing of the liquid core reduction.

Since the level of strains causing the occurrence of internal cracks for a particular steel, referred to here as critical amount ($\epsilon_{CR}$), can be determined by such a method as described in "Materials & Processes" Vol. 1 (1988) p.1229, for example, operating conditions which will not produce internal cracks can be obtained from equation (8) as follows.

$$\epsilon_R = 9000\frac{D\cdot V_R\cdot L_S}{L^2\cdot V_C} < 0.5\ \epsilon_{Cr} \tag{9}$$

or $$V_R < (V_R)_{Cr} = \epsilon_{Cr}\frac{5L^2V_C}{9DL_S}\times 10^{-4} \tag{10}$$

wherein $V_R$: Raising speed of the exit roll in a liquid core reduction zone.

$V_C$: casting speed (m/min)

L: minimum roll pitch i.e., minimum distance from one roll to the next roll (mm)

$L_S$: length of the liquid core reduction zone to give a target thickness (m)

$\epsilon_{Cr}$: amount of strains causing internal cracks for steel to be cast (%)

D: maximum solidified shell thickness at the exit of a liquid core reduction roll (mm)

If the roll pitch L (mm) can take different values within the liquid core reduction area to give a target reduction, it is advisable from the viewpoint of safety to use as a minimum roll pitch a distance from a roll nearest to the meniscus within the liquid core reduction rolls to the first roll which can provide a target pressure. In addition, although the solidified shell thickness increases slightly in the liquid core reduction area where a target reduction is achieved, the solidified shell thickness t the exit of the liquid core reduction area can be used. The solidified shell thickness can be obtained by calculation or measurement. Alternatively, after determining the solidification coefficient K based on the results of the calculation and measurement, the shell thickness can be obtained by the following empirical formula:

$$D=K\sqrt{(L_e/V_C)} \tag{11}$$

Instead of using Le, which means the distance (m) from the meniscus, the distance from the meniscus to the final roll in the liquid core reduction area where a target reduction is achieved can be used for the sake of safety. The above method is not affected by a reduction during liquid core reduction and is effective in a case where releasing is carried out after a small amount of reduction, i.e., slight reduction.

Although the before-mentioned prevention f the occurrence of internal cracks has been described with reference to segmented groups of rolls, an upper limit of the raising speed of a pair of rolls which are not segmented can be determined in the same manner.

Since the thickness of cast slabs is small in the continuous casting method employing liquid core reduction, and the solidification finishing position is rather near the meniscus compared with that after release of reduction, it is possible to advantageously increase production speed by increasing the casting speed. If such high speed of casting is continued after releasing is initiated, the solidification finishing portion shifts outside the machine, resulting in bulging after leaving the machine. Marked deteriorations in inner quality and shape of products are inevitable. It is necessary, therefore, that the casting speed be within a range where the signification finishing position can be kept within an area of the casting machine.

EXAMPLE 1

This example specifically shows that control of roll reduction can easily be done depending on changes of operational conditions during the liquid core reduction operation.

First, progresses of solidification were simulated on the basis of calculations for a case where the liquid core reduction as not carried out. A simulation model was one-dimensional model for a portion of ½ the thickness of the slab.

The thickness of mold, i.e., thickness of cast slab within the mold was 90 mm. The distance of cast slab from a molten metal level within the mold was shown with respect to the solidified shell thickness and temperature in FIGS. 13*a* and 13*b,* respectively. According to the results thereof, it is possible to determine a roll reduction position, i.e., reference position, where the thickness of the solidified shell was equal to a target thickness.

If cooling conditions, such as temperature of a cooling water are changed, the thickness of the solidified shell is varied even in the same roll area. In this simulation, since the results are for the ½ thickness portion, a solidified shell thickness of 45 mm means complete solidification.

Now take an example where a cast slab of 90 mm thick is reduced to a thickness of 60 mm, i.e, a roll reduction by 30 mm is carried out.

Figure 13A:
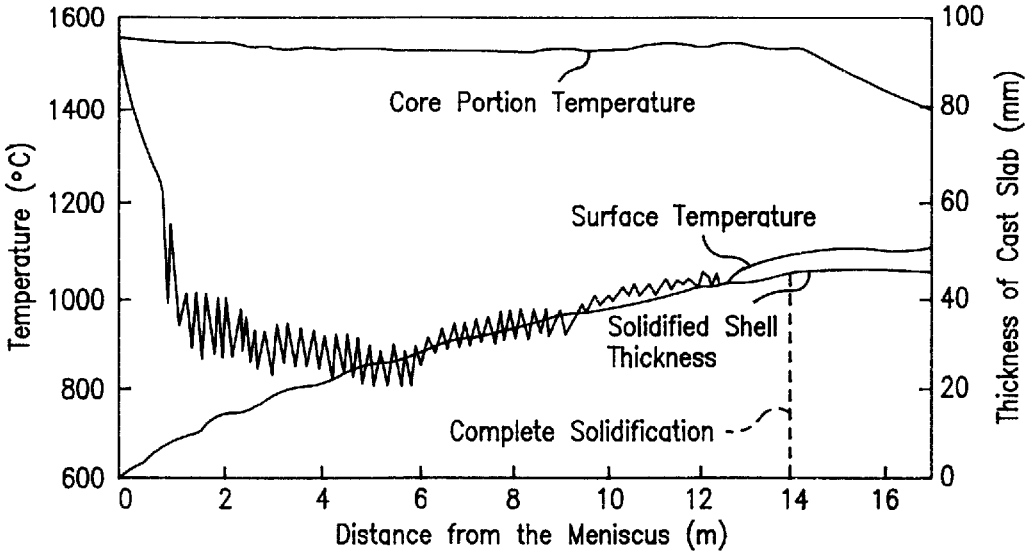
FIGS. 13*a* and 13*b* are graphs showing results obtained by calculating the thickness of a solidified shell based on thermal conductivity.

According to FIG. 13*a,* at a position of 7 m from the meniscus within the mold the thickness of the solidified shell is 30 mm for the half, i.e, 60 mm for the whole, and the thickness of liquid core is 90 mm−60 mm=30 mm.

Thus, if a reduction with a roll positioned at a distance of 7 m from the meniscus is completely carried out, an unsolidified portion of 30 mm thick is squeezed so that the opposing solidified portions are contacted together to give a slab having a solidified thickness of 60 mm. Namely, a roll reduction is 30 mm. In this case, therefore, for the reduction rolls upstream of the pivot reduction roll at a distance of 7 m from the meniscus, roll reduction control may be performed, and for the reduction rolls downstream of the pivot reduction roll, pressure control, i.e., reaction force control may be performed.

Figure 13B:
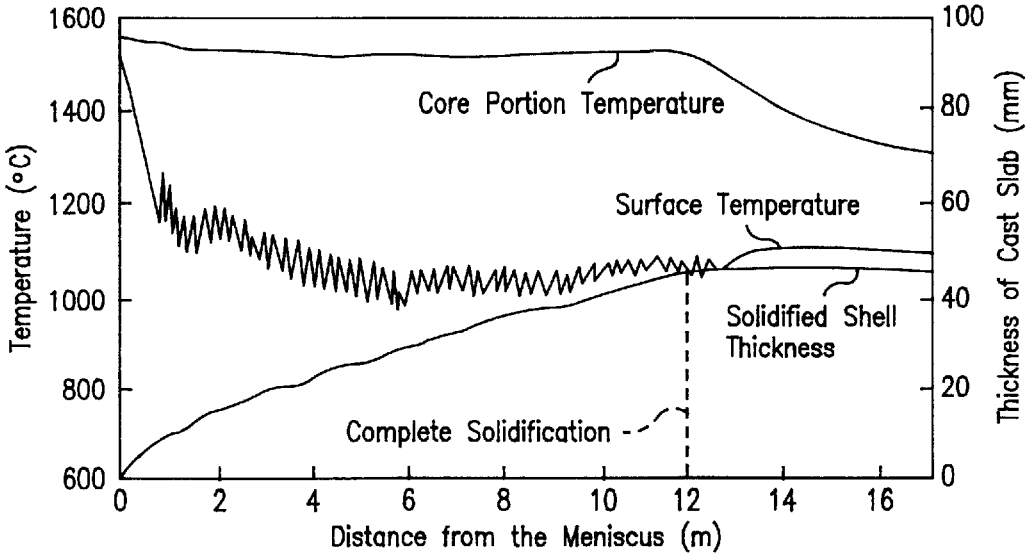

Similarly, in the case shown in FIG. 13*b,* since the thickness of the solidified portion is 30 mm for the half of the slab and 60 mm for the whole at a distance of 6 m from the meniscus, for the reduction rolls upstream of the pivot reduction roll at a distance of 6 m from the meniscus, roll reduction control may be performed, and for the reduction rolls downstream by a distance of 6 m, reaction force control may be performed.

Comparing the cases of FIG. 13*a* and FIG. 13*b,* which differ from each other in the position of the pivot roll where the thickness of a liquid core is equal to the reduction, it is noted that the roll reduction conditions must be changed.

However, according to the prior art method, in which spacers are used as stoppers to mechanically stop the reduction of rolls to perform reduction under a constant reaction force, or in which the reduction of rolls is performed in a fixed pattern, the following problems occur when operational conditions are to be changed.

Namely, when the thickness of an unsolidified portion is small at the reduction roll position of the pivot reduction device, the thickness of the solidified shell is larger than the target thickness after reduction, even if the reduction is performed.

According to the present invention, if an unsolidified portion remains at z pivot reduction roll which is selected by the automatic position control (APC) system, segregation can not e eliminated. Therefore it is desirable that the thickness of an unsolidified portion be substantially zero at the pivot reduction roll position.

Figure 14:
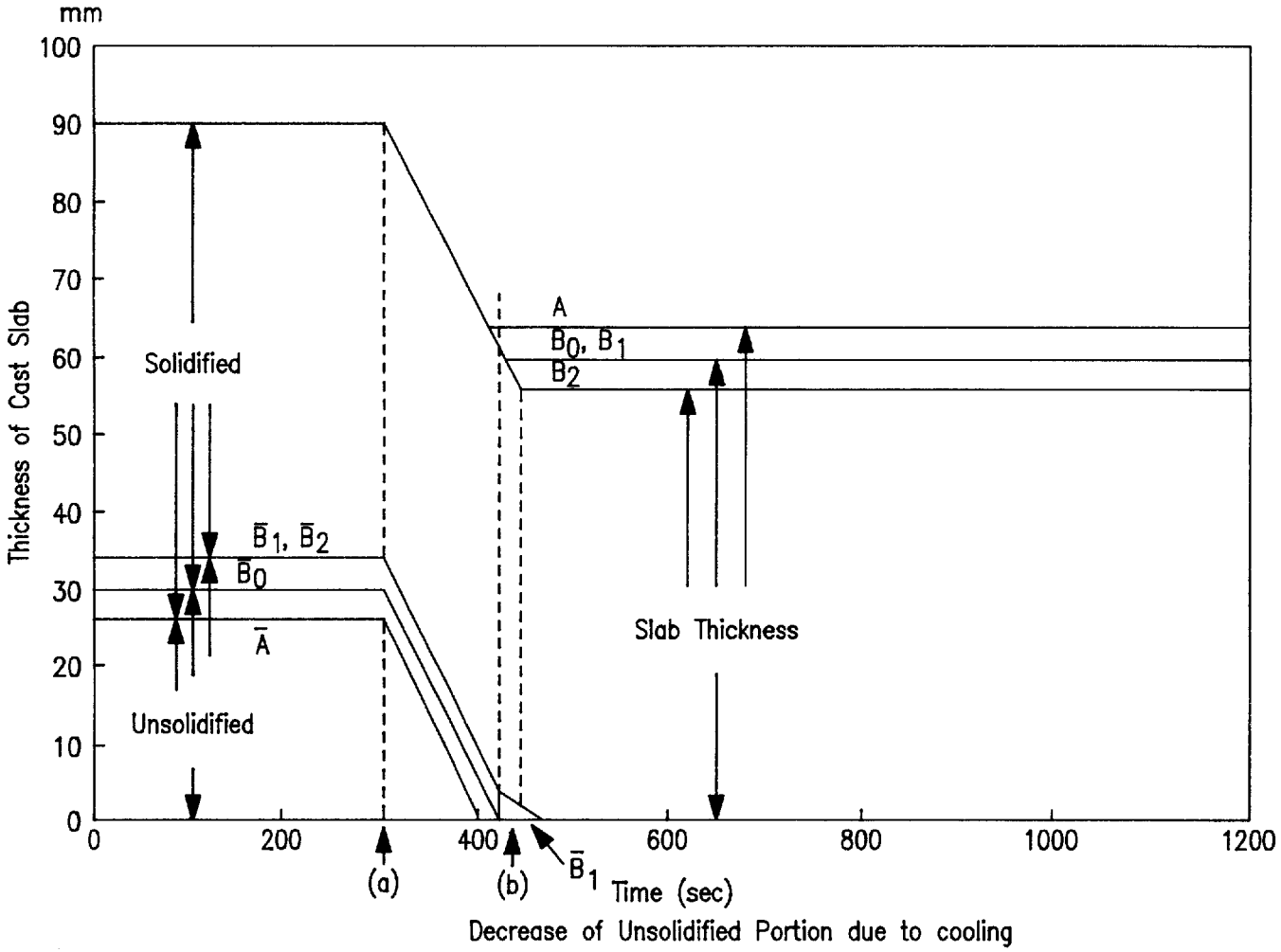
FIG. 14 is a graph showing the thickness of a solidified shell and the thickness of a liquid core with respect to time at the position of the pivot reduction roll.

Based on the calculation f thermal conductivity shown in FIGS. 13*a* and 13*b,* or based on equation (2), the performance of a cast slab from the beginning of roll reduction to the end of roll reduction at the point where the thickness of an unsolidified portion is 30 mm, as well as changed in the thickness of the unsolidified portion (unsolidification thickness) and that of a solidified portion (solidification thickness) were simulated. The results are shown in FIG. 14.

In this figure, the most suitable roll position which was determined by APC was in Case $B_0$ exhibiting a solidification thickness $B_0$ and an unsolidification thickness $\overline{B}_0$. At a first position (a) of the roll to which APC is applied, the reduction is substantially equal to the unsolidification thickness, and at a finishing position (b), i.e., the roll position of the pivot reduction device, the unsolidification thickness is zero. If reaction force control is applied to the rolls downstream of the pivot roll, therefore, the slab thickness does not change but is 60 mm, a target thickness.

The roll position is unsuitable in Case A. This is the case in which at a first position (a) of the roll to which APC is applied, the solidification thickness is small. When the roll reduction reaches 30 mm, an unsolidified portion still remains. If reaction force control is not applied to the rolls downstream, as shown in Case $B_1$, a target slab thickness of 60 mm can be achieved, but an unsolidified portion is being cooled and solidified, resulting in no elimination of center line segregation.

In contrast, if reaction force control is applied to rolls downstream, the slab thickness will be 60 mm or less just like the case shown as Case $B_2$. a pattern of the roll position control (APC) is changed. Changes in roll reduction and reduction pressure are plotted with respect to time for a final roll to which the roll position control by APC is applied.

Figure 15:
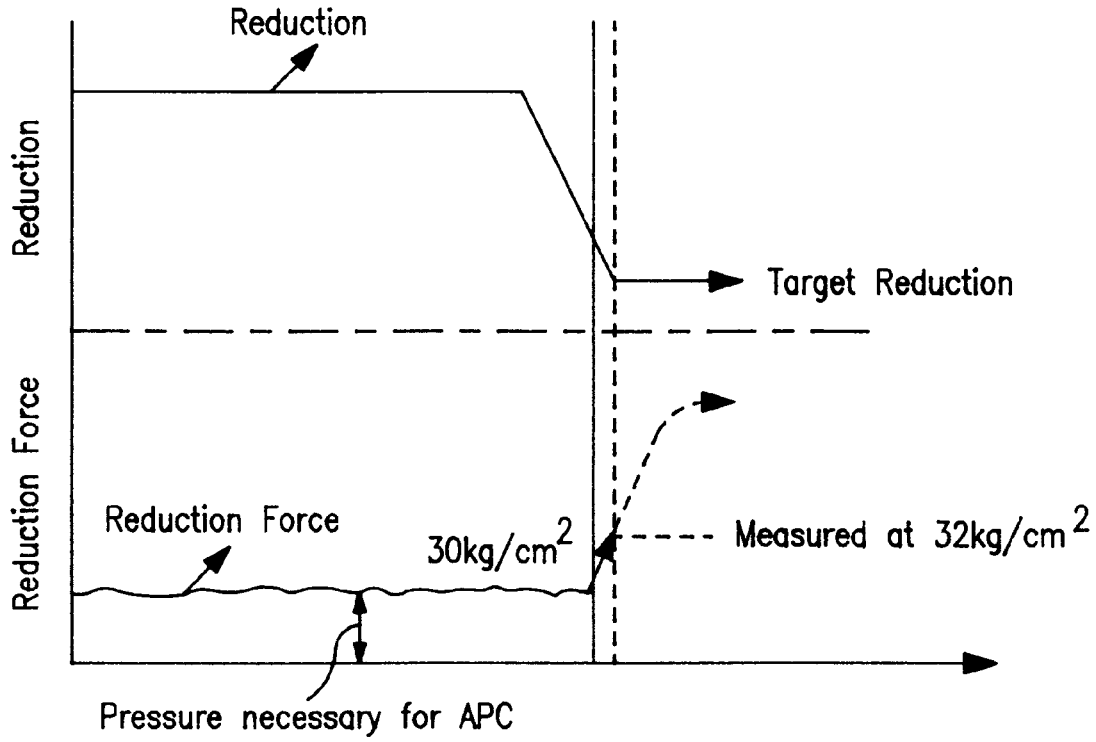
FIG. 15 is a graph showing results of a simulation of changing roll gap patterns during control of a roll gap.

The reaction force during roll reduction can be described as $(P_i+\alpha)$. The value of $P_i$ can be determined by equation (3) to be about 30 kg/cm$^2$ in this case. The reaction force $(P_i+\alpha)$ rapidly increases when the roll reduction comes to an end. The inventors determined by separate experiments the pressure to be 32 kg/cm$^2$ at which the reaction force control of rolls downstream is carried out.

i) as is apparent from FIG. 15, when the reaction force increases rapidly prior to reaching the target reduction, the solidification thickness is so large that the resulting slab thickness would be excessively larger than the target one even if the reaction force control were applied to the rolls downstream.

Therefore, the pattern of roll position control (APC), i.e., the roll positions to which APC is applied, is shifted upstream, i.e., a new pattern of position control has a sharp gradient, and the reaction force control is applied to rolls downstream of the roll to which APC control is applied.

ii) In contrast, when the reaction force does not increase rapidly after reaching the target reduction, it is decided that the solidification thickness is too small. Therefore, the roll positions to which APC is applied are shifted downstream, i.e., a new pattern of position control has a sharp gradient, and the reaction force control is applied to rolls downstream of the roll to which APC control is applied.

In these respects, the roll reduction control and the reaction force control were carried out in accordance with the manners shown in FIGS. 4 and 5.

Thus, according to the present invention, cast slabs having a precise thickness can be produced with center line segregation being effectively eliminated.

EXAMPLE 2

Figure 8:
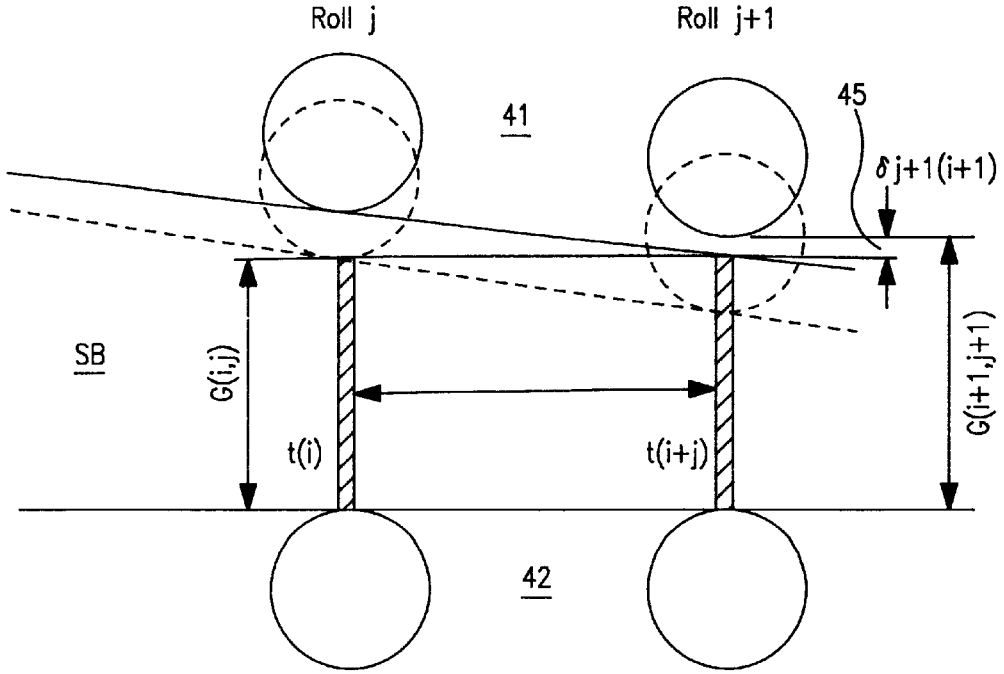
FIG. 8 is an illustration showing the occurrence of clearance between the cast slab and supporting rolls during releasing roll reduction.

In this example, using a casting machine of the bending type (cast slab thickness=90 mm, cast slab width=100 mm, curvature bending radius=3.5 m, straight portion length=1.6 m, and machine length=13 m), cast slabs having the steel compositions shown in Table 1 were forged in roller apron zone (2.9–3.86 m from the meniscus) with a roll reduction of 20 mm being performed by the liquid core reduction segment shown in FIG. 8. When the roll reduction of 20 mm was released to return to a 90 mm slab, the control process of the present invention was carried out. In this continuous casting machine, the length $L_S$ was 760 mm. Since a roll pitch of from the middle of the liquid core reduction segment in the casting direction to an inlet of the next segment of usual rolls was 190–195 mm, the value of L in equation (9) was set to 190 mm in carrying out the present invention.

TABLE 1

| Steel | Steel Composition (wt %) C | P | S | Critical Strains $\epsilon cr$ (%) |
|---|---|---|---|---|
| A | 0.15 ~ 0.20 | 0.015 ~ 0.02 | 0.01 ~ 0.015 | 1.6 |
| B | 0.15 ~ 0.20 | 0.015 ~ 0.02 | <0.01 | 2.3 |
| C | 0.2 ~ 0.4 | 0.015 ~ 0.02 | 0.01 ~ 0.015 | 1.0 |
| D | 0.4 ~ 0.9 | 0.015 ~ 0.02 | 0.01 ~ 0.015 | 0.8 |
| E | 0.15 ~ 0.1 | 0.015 ~ 0.02 | 0.01 ~ 0.015 | 2.0 |

Table 2 shows the results of the present invention together with those of comparative examples. In Table 2, Vc stands for a steady casting speed at which cast slabs having respective steel compositions were cast with a thickness of 90 mm. The casting speed was increased by 20–30% higher than the steady casting speed when the liquid core reduction was being carried out. Occurrence of internal cracks during release of the roll reduction was determined by the development of cracks on the surface of a specimen which was cut from a central portion of the cast slab in the widthwise direction and subjected to sulphur printing and dendrite etching.

In applying the method of the present invention, the solidification thickness was found by calculation after thoroughly confirming the precision thereof based on measurements previously obtained.

According to the method of the present invention, there were no internal cracks. However, when the releasing of roll reduction was carried out using the value of $V_R$ which was not satisfied by equation (10), the length of a non-steady tapered slab was a little short compared with that in the case of the present invention, but the cast slab suffered from occurrence of internal cracks. Furthermore, in Comparative Example No. 11, the releasing speed satisfied equation (10), but the casting speed during release of the liquid core reduction was larger than the steady casting speed for 90 mm thick cast slabs after finishing the release of reduction. The final solidification position, therefore, was located outside the machine and bulging occurred outside the machine, resulting in formation of internal cracks.

TABLE 2

| No. | Steel | $V_C$ (m/min) | $V_R$ (mm/s) | $(V_R)cr$ (mm/s) | Equation (10) | Length of Tapered Slab (m) | Internal Cracks | Remarks |
|---|---|---|---|---|---|---|---|---|
| 1 | A | 4.1 | 0.60 | 0.65 | ○ | 2.9 | No cracks at all | Invention |
| 2 | B | 4.1 | 0.90 | 0.94 | ○ | 2.1 | | |
| 3 | C | 3.8 | 0.35 | 0.37 | ○ | 4.5 | | |
| 4 | D | 3.5 | 0.25 | 0.26 | ○ | 5.6 | | |
| 5 | E | 5.0 | 1.05 | 1.10 | ○ | 2.3 | | |
| 6 | A | 4.1 | 0.70 | 0.65 | X | 2.7 | Yes | Comparative |
| 7 | B | 4.1 | 1.00 | 0.94 | X | 2.0 | | |
| 8 | G | 3.8 | 0.42 | 0.37 | X | 3.9 | | |
| 9 | D | 3.5 | 0.31 | 0.26 | X | 4.6 | | |
| 10 | E | 5.0 | 1.20 | 1.10 | X | 2.0 | | |
| 11 | A | 4.5* | 0.73 | 0.75 | ○ | 2.8 | | |

Note: Higher than normal casting speed for 90 mm thick slabs.

INDUSTRIAL APPLICABILITY

According to the present invention, control of roll reduction position as well as reaction force in response to the roll reduction can be carried out. In addition, the thickness of cast slabs can be freely increased or decreased with high precision, and cast slabs having a uniform inner structure can be obtained with a centrl portion of cast slab being free of segregation of impurities. Furthermore, since it is possible to produce cast slabs having a thickness required for subsequent hot rolling steps, loads to the hot rolling mills can be reduced markedly, resulting in an increase in productivity.

In addition, since the pivot roll position can be corrected, cast slabs having a predetermined thickness can be produced with high precision.

Lastly, it is possible to control the reduction position as well as the reduction force without using expensive apparatuses with a servomechanism, so the present invention has advantages with respect to equipment costs.

We claim:

1. A process for continuously casting a slab, which comprises:

supplying a cast slab having a liquid core and continuously withdrawn from a mold to a plurality of reduction devices arranged in tandem, providing a target roll reduction or a target pressure to each of the reduction devices, performing roll reduction with the target roll reduction and target pressure capable of being achieved for each of the reduction devices, selecting one of the plurality of reduction devices as a pivot reduction device where the thickness of the solidified shell of the cast slab reaches a target thickness of the cast slab, providing a target roll reduction to the pivot reduction device and each of the reduction devices located upstream of the pivot reduction device, and providing a target pressure to each of the reduction devices located downstream of the pivot reduction device.

2. A process for continuously casting a slab as set forth in claim 1, wherein a thickness of the cast slab is increased or decreased after passing through the plurality of reduction devices as compared with a thickness the slab when continuously withdrawn from the mold.

3. A process for continuously casting a slab as set forth in claim 1, further comprising detecting a thickness of the cast slab at the exit of the pivot reduction device, detecting a reduction roll position of the pivot reduction device, and shifting the pivot reduction device based on the detected thickness of the cast slab at the exit of the pivot reduction device and based on the detected reduction roll position.

4. A process for continuously casting slabs as set forth in claim 1, wherein the target roll reduction is calculated based on a difference between a thickness of the cast slab at the exit of the mold and the target thickness of the cast slab.

5. A process for continuously casting slabs as set forth in claim 1, wherein the slab is composed of steel and the target pressure is calculated based on a preset value of the reaction force to the reduction, which is determined depending on a composition of the steel slab and depending on a static iron pressure at each of the reduction devices.

6. A process for continuously casting a slab as set forth in claim 1, wherein the reduction device comprises a double acting hydraulic cylinder, pressure control valves for adjusting pressure to the hydraulic cylinder, a detector for detecting the roll reduction, and a pressure meter for detecting applied pressure, in the case of either increasing or decreasing the thickness of the cast slab, the target pressure and a direction of application of pressure are determined for the pivot reduction device and each reduction device located upstream of the pivot reduction device based on detected results of the detector and an assigned target roll reduction, a degree of opening of said pressure control valve is determined based on the target pressure and a detected pressure of the pressure meter, the pressure control valve is operated to achieve the degree of opening and to switch the direction of pressure application, and the degree of opening of the pressure control valve is determined for each reduction device located downstream of the pivot reduction device based on an assigned target pressure and the detected results of the pressure meter, and the pressure control valve is operated to achieve the predetermined degree of opening.

7. A process for continuously casting a slab as set forth in claim 1, wherein a continuous cast thin slab of steel is produced by applying reduction of thickness of a cast slab having a liquid core in a roll reduction zone, the roll reduction force is released in such a way that a rate of increasing the final roll reduction is satisfied by the following equation, which determines the target roll reduction, when the thickness of the cast slab is returned to a thickness smaller than the original thickness of the cast slab before application of roll reduction:

$$V_R < (V_R)_{Cr} = \epsilon_{Cr}\frac{5L^2V_C}{9DL_S}\times 10^{-4}$$

wherein $V_R$: raising rate of the reduction roll (mm/S)

$V_o$: casting speed (m/min)

L: minimum roll pitch (mm)

$L_S$: length of roll reduction zone (m)

$\epsilon_{Cr}$: critical strains of internal cracks of cast steel (%)

D: maximum solidified shell thickness at the exit of a liquid reducing roll (mm).

8. A process for continuously casting a slab as set forth in claim 1, wherien the reduction device comprises a pair of reduction rolls.

9. A process for continuously casting a slab as set forth in claim 1, wherein the reduction device comprises a segmented group of a plurality of pairs of rolls.

10. A continuous casting apparatus in which a cast slab continuously withdrawn from a mold is supplied to a plurality of reduction devices arranged in tandem, a target oil reduction or target pressure is assigned to each of the reduction devices, and roll reduction of a liquid core with the target roll/reduction position or target pressure being able to be achieved for each of the reduction devices is performed, comprising:

means for selecting any one of the plurality of reduction devices as a variable pivot reduction device, means for assigning a target roll reduction to the pivot reduction device and each of the reduction devices upstream of the pivot reduction device, means for assigning a target pressure to each of the reduction devices downstream of the pivot reduction device, means for providing a roll reduction smaller than the thickness of the mold based on means for providing a target roll reduction, when a roll reduction is decreased, and means for providing a roll reduction larger than that being used, based on the means for providing a target roll reduction, when the roll reduction is increased.

11. A process for continuously casting a slab, comprising:

supplying a continuously cast slab to a plurality of reduction rollers;

performing roll reduction with the plurality of reduction rollers to obtain an outputted cast slab having a target thickness;

selecting one of the plurality of reduction rollers as a pivot reduction device at which the cast slab has the target thickness during said performing of roll reduction;

providing a target roll reduction to the pivot reduction device and at least one reduction roller of the plurality of reduction rollers located upstream of the pivot reduction device with respect to a conveyance direction of the slab; and providing a target pressure to at least one reduction roller of the plurality of reduction rollers located downstream of the pivot reduction device with respect to the conveyance direction of the slab.

* * * * *